US011229817B2

(12) United States Patent
Tomellini et al.

(10) Patent No.: US 11,229,817 B2
(45) Date of Patent: Jan. 25, 2022

(54) FITNESS TRAINING BAGS

(71) Applicant: Lindon Group, Inc., East Providence, RI (US)

(72) Inventors: Dalita Tomellini, Rehoboth, MA (US); Melinda Penney, Providence, RI (US); Phillip Brooks, Franklin, MA (US); Lindsay Pettinelli, Providence, RI (US)

(73) Assignee: Lindon Group, Inc., East Providence, RI (US)

( * ) Notice: Subject to any disclaimer, the term of this patent is extended or adjusted under 35 U.S.C. 154(b) by 6 days.

(21) Appl. No.: 16/407,642

(22) Filed: May 9, 2019

(65) Prior Publication Data

US 2019/0299046 A1 Oct. 3, 2019

Related U.S. Application Data

(63) Continuation-in-part of application No. 15/304,748, filed as application No. PCT/US2015/026024 on Apr. 15, 2015, now Pat. No. 10,293,201.

(Continued)

(51) Int. Cl.

*A63B 21/06* (2006.01)
*A63B 21/00* (2006.01)

(Continued)

(52) U.S. Cl.

CPC ..... *A63B 21/0603* (2013.01); *A63B 21/075* (2013.01); *A63B 21/4035* (2015.10); *A63B 21/4043* (2015.10); *A63B 2071/0063* (2013.01)

(58) Field of Classification Search

CPC ..... A63B 21/0602; A63B 21/0603; A63B 21/06–0607; A63B 69/12; A63B 69/201; A63B 2244/203

See application file for complete search history.

(56) References Cited

U.S. PATENT DOCUMENTS 4,162,547 A * 7/1979 Jenkins ..... A61J 19/00 4/259
4,659,495 A * 4/1987 Figliola ..... A61K 8/02 206/0.5

(Continued)

FOREIGN PATENT DOCUMENTS

CN 2309867 Y * 3/1999
CN 202070110 U 12/2011

(Continued)

OTHER PUBLICATIONS

International Search Report PCT/US/2015/026024 dated Oct. 22, 2015 (Year: 2015).*

(Continued)

*Primary Examiner* — Nyca T Nguyen

(74) *Attorney, Agent, or Firm* — Carter, DeLuca & Farrell LLP

(57) ABSTRACT

A fitness training bag is provided and includes a body having a first interior volume therein that houses a bladder disposed within the first interior volume. The bladder defines a second interior volume therein that houses a fluid disposed within the second interior volume. A handle is coupled to the body and is configured to facilitate manipulation of the body to perform an exercise. An outer bag for a fitness bag and a fitness training bag system are also provided.

9 Claims, 15 Drawing Sheets

Related U.S. Application Data

(60) Provisional application No. 61/981,038, filed on Apr. 17, 2014, provisional application No. 62/669,050, filed on May 9, 2018.

(51) Int. Cl.
*A63B 21/075* (2006.01)
*A63B 71/00* (2006.01)

(56) References Cited

U.S. PATENT DOCUMENTS 5,417,635 A 5/1995 Sell
5,546,707 A 8/1996 Caruso
6,022,024 A * 2/2000 Kahn ..... A63B 63/007 273/317
6,099,441 A * 8/2000 Bonnet ..... A63B 21/072 482/106
6,149,555 A * 11/2000 Kinback ..... A63B 21/06 383/10
6,217,489 B1 4/2001 Nicholson
6,241,637 B1 6/2001 Basyuk
6,261,210 B1 7/2001 Lishejkov et al.
6,301,722 B1 10/2001 Nickerson
6,332,822 B2 * 12/2001 Greenberg ..... A63B 69/12 446/153
6,827,674 B1 * 12/2004 Ferry ..... A63B 69/201 482/83
7,828,703 B1 * 11/2010 Boesch ..... A63B 23/12 482/112
8,276,351 B1 10/2012 Henkin
D672,414 S 12/2012 Januszek
8,771,152 B1 7/2014 Silverman et al.
10,252,097 B1 * 4/2019 Raines ..... A63B 21/0602
2001/0003645 A1 * 6/2001 Greenberg ..... A63B 69/12 434/236
2004/0197754 A1 * 10/2004 Coppelli ..... A63B 69/12 434/254
2007/0099772 A1 * 5/2007 Fu ..... A63B 69/201 482/83
2007/0281806 A1 * 12/2007 Wong ..... A63B 31/00 473/447
2008/0096733 A1 * 4/2008 Epstein ..... A63B 69/201 482/83
2009/0286632 A1 * 11/2009 Laliberty ..... A63B 43/04 473/603
2010/0022361 A1 1/2010 Raines
2010/0048363 A1 * 2/2010 Gilberti ..... A63B 21/065 482/105
2011/0165978 A1 * 7/2011 Leefeldt ..... A63B 43/04 473/594
2012/0021857 A1 1/2012 Raymond
2012/0053021 A1 * 3/2012 Sherstnev ..... A63B 69/12 482/55
2012/0322627 A1 * 12/2012 Emerson ..... A63B 21/0605 482/93
2012/0329619 A1 * 12/2012 Goldberg ..... A63B 21/4037 482/129
2013/0005520 A1 * 1/2013 Chang ..... B29C 65/4815 473/604
2013/0040789 A1 * 2/2013 Kessler ..... A63B 21/072 482/108
2013/0157815 A1 * 6/2013 Reynolds ..... A63B 21/072 482/93
2014/0038791 A1 * 2/2014 Bell ..... A63B 69/12 482/111
2014/0309089 A1 * 10/2014 Buikema ..... A63B 21/0004 482/105
2016/0059100 A1 * 3/2016 Chen ..... A63B 69/34 482/83
2016/0129292 A1 * 5/2016 Stroup ..... A63B 21/00065 482/93
2017/0021221 A1 * 1/2017 Hannula ..... A63B 21/065
2017/0050072 A1 * 2/2017 Connelly ..... A63B 21/0603
2018/0008858 A1 * 1/2018 Brooks ..... A63B 21/0084
2018/0169456 A1 * 6/2018 Rachele ..... A63B 21/0603
2018/0333603 A1 * 11/2018 Peyton ..... A63B 21/0602
2018/0369632 A1 * 12/2018 Peloquin ..... A63B 31/10
2019/0030392 A1 * 1/2019 Skerjanz ..... B32B 27/36
2019/0184252 A1 * 6/2019 Raines ..... A63B 21/072
2019/0282880 A1 * 9/2019 Bortolotto ..... A63B 69/201
2019/0308055 A1 * 10/2019 Bowers ..... B29C 66/1122

FOREIGN PATENT DOCUMENTS

EP 1501611 A1 * 2/2005 ..... A63B 21/0004
EP 2520341 A1 * 11/2012 ..... A63B 21/0726
WO WO-03092823 A1 * 11/2003 ..... A63B 21/0609

OTHER PUBLICATIONS

International Written Opinion PCT/US/2015/026024 dated Oct. 22, 2015 (Year: 2015).*
Supplementary European Search Report dated Oct. 9, 2017, issued in 15 78 0608.
European Search Report dated Jan. 19, 2019 issued in corresponding EP Appln. No. 18197877.6.

* cited by examiner

FITNESS TRAINING BAGS

CROSS-REFERENCE TO RELATED APPLICATIONS

This application is a continuation-in-part of U.S. patent application Ser. No. 15/304,748, filed Oct. 17, 2016, which is a U.S. National Stage Application filed under 35 U.S.C. § 371(a) of International Application Serial No. PCT/US2015/026024, internationally filed Apr. 15, 2015, which claims the benefit of, and priority to, U.S. Provisional Patent Application No. 61/981,038, filed on Apr. 17, 2014. The entire contents of each of the above disclosures are hereby incorporated herein by reference.

This application also claims the benefit of, and priority to, U.S. Provisional Patent Application No. 62/669,050, filed on May 9, 2018, the entire contents of which are hereby incorporated by references herein.

BACKGROUND

Technical Field

The present disclosure relates to exercise and fitness equipment and, more particularly, to fitness training bags.

Background of Related Art

Fitness training bags are known in the art for use during the course of a workout or training session. In particular, fitness training bags are lifted, carried, manipulated, thrown, and/or dropped in various ways for exercise and fitness purposes. Currently, fitness training bags take the form of a sewn sack filled with sand. Typically, the empty sacks are sold to the consumer, who then fills the sack with sand to a desired weight.

Sand-filled sacks are disadvantageous for numerous reasons. For example, due the fine particulate nature of sand, sand has a tendency to leak out of the sack after repeated use and normal wear and tear on the sack, especially during outdoor use when subject to adverse weather conditions and UV light. As can be appreciated, the leaking sand leaves behind a mess and alters the weight of the sack.

Another disadvantage of sand-filled sacks is that sand is water-absorbent, which can significantly increase the weight of the sack should water or moisture penetrate the sack. As such, sand-filled sacks are limited to indoor use or must be carefully monitored to avoid contact with water and moisture when used outdoors. In an attempt to inhibit water and moisture penetration, some sacks are formed from more solid materials. However, should water and/or moisture penetrate the more solid material and be absorbed by the sand, the solid material acts to trap that water and/or moisture within the sack. Thus, drying the sand within the sack becomes exceedingly difficult and may result in mold and mildew buildup within the sack.

Further still, sand-filled sacks are relatively stiff and lack shock-absorbing properties. As such, lifting, carrying, manipulating, throwing, and/or dropping the sack may be awkward and/or uncomfortable for the user.

Accordingly, there is a continuing for a weather-proof, durable, versatile, shock-absorbing, and comfortable fitness training bag to facilitate a user's workout or training session. Environmental friendliness, both in manufacture and use, is also desired.

SUMMARY

To the extent consistent, any of the aspects described herein may be used in conjunction with any of the other aspects described herein.

The present disclosure is directed to a fitness training bag including a body defining a first interior volume, a bladder disposed within the first interior volume and defining a second interior volume therein, a fluid disposed within the second interior volume, and a handle coupled to the body and configured to facilitate manipulation of the body to perform an exercise.

In aspects, the body includes an outer bag enclosing a first interior area therein. The bladder is disposed within the first interior area.

In other aspects, the body includes an inner bag disposed within the first interior area of the outer bag. The inner bag defines a second interior area therein.

In certain aspects, the bladder is disposed within the second interior area.

In other aspects, a first end of the outer bag defines an opening therein in operable communication with the first interior area. The outer bag includes a first closure disposed on an inner surface thereof that is configured to selectively cover the opening on an exterior portion thereof.

In aspects, the outer bag includes a second closure disposed on an inner surface thereof that is configured to selectively cover the opening on an interior portion thereof.

In certain aspects, the fitness training bag includes dehydrated water beads disposed within the second interior volume.

In aspects, the dehydrated water beads are superabsorbent polymers.

In certain aspects, the dehydrated water beads are high density cross-linking superabsorbent polymers.

In other aspects, the dehydrated water beads are low density cross-linking superabsorbent polymers.

In accordance with another aspect of the present disclosure, an outer bag for a fitness training bag system includes a body configured to enclose a first interior area therein. The body is water-permeable and includes a first end portion and a second end portion. The first end portion includes a first closure mechanism configured to selectively provide access to the first interior area. The first interior area is configured to receive an inner bag therein. The closure mechanism is configured to selectively close the first end portion.

In aspects, the closure mechanism includes a first strap and a second strap that are configured to selectively close the first end portion.

In certain aspects, the first strap includes a fastener system and the second strap includes a loop. The first strap is configured to pass through the loop and secure to itself via the fastener system to selectively close the first end portion.

In other aspects, the first strap includes part of a fastener system and the second strap includes a complementary part of the fastener system. The first strap is configured to secure to the second strap to selectively close the first end portion. In certain aspects, the first strap may be configured to tie the second strap to selectively close the first end portion.

In other aspects, the body includes a second closure mechanism configured to selectively close the second end portion.

In certain aspects, the inner bag defines a second interior area. A filler material is disposed within the second interior area.

In accordance with another aspect of the present disclosure, a fitness training bag system includes a water-permeable outer bag enclosing a first interior area therein, the outer bag having a first end portion and a second end portion, a water-permeable inner bag disposed within the first interior area. The inner bag encloses a second interior area therein. A filler is disposed within the second interior area and includes a plurality of pieces of material. The plurality of pieces of material is non-absorbent, drainable, and non-packable. Some or more of the plurality of pieces of material are resiliently compressible so as to be shock-absorbing. A first closure mechanism is configured to selectively close the first end portion of the outer bag to enclose the inner bag within the first interior area.

In aspects, the first closure mechanism includes a first strap and a second strap. The first and second straps are configured to selectively close the first end portion.

In certain aspects, the first strap includes a fastener system and the second strap includes a loop. The first strap is configured to pass through the loop and secure itself via the fastener system to selectively close the first end portion.

BRIEF DESCRIPTION OF THE DRAWINGS

Various aspects and features of the present disclosure are described hereinbelow with reference to the drawings wherein like reference numerals identify similar or identical elements.

DETAILED DESCRIPTION

Figure 1:
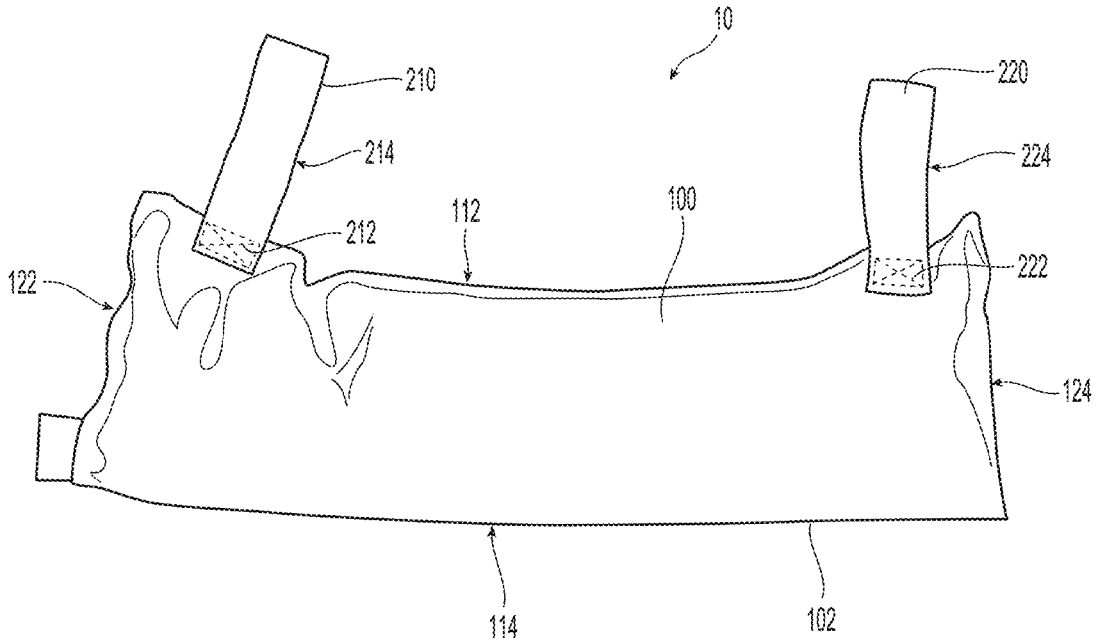
FIG. 1 is a perspective view of a fitness training bag provided in accordance with the present disclosure.
Figure 2:
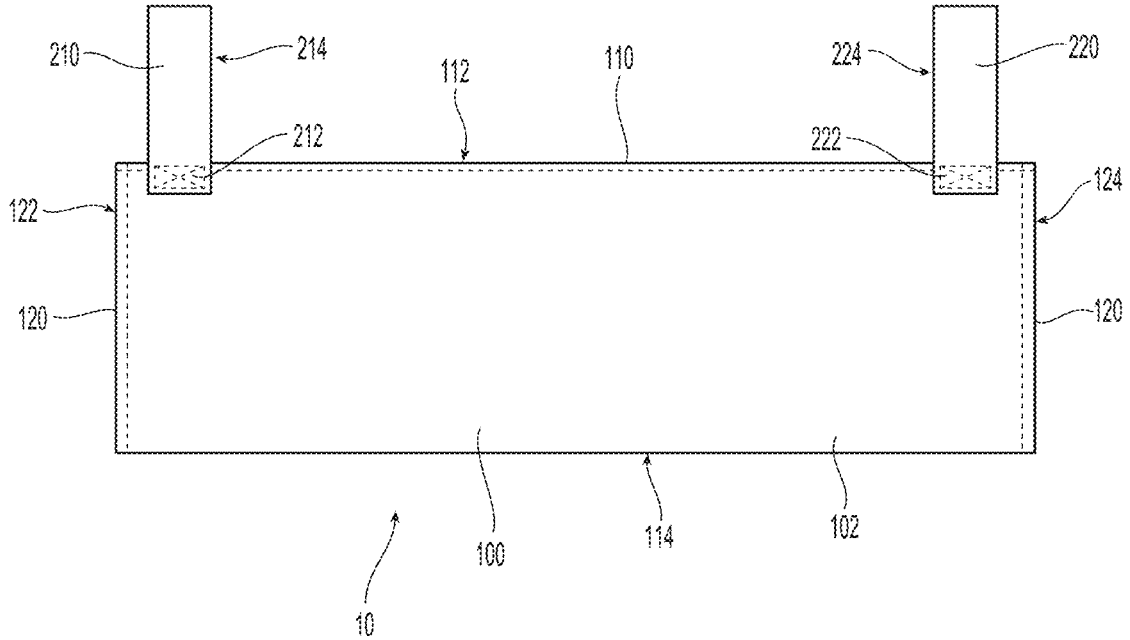
FIG. 2 is a side view of the fitness training bag of FIG. 1.

Turning to FIGS. 1 and 2, a fitness training bag provided in accordance with the present disclosure is shown generally identified by reference numeral 10. Fitness training bag 10 generally includes a body 100 having first and second handles 210, 220 engaged to body 100 and extending therefrom.

Body 100 of fitness training bag 10 includes an outer bag 102 formed from a generally rectangular sheet of material having a pair of opposed long edges 110 and a pair of opposed short edges 120. During manufacture, the sheet of material forming outer bag 102 is bent back upon itself to align the long edges 110 thereof, thus enabling the long edges 110 to be sewn together along an upper portion 112 of outer bag 102, while the bend in the sheet of material defines the lower portion 114 of outer bag 102. As a result of bending back the sheet of material forming outer bag 102 in the above-detailed manner, short edges 120 are bent in half, thus enabling the opposed halves of each of the short edges 120 to be sewn together to define end portions 122, 124 of outer bag 102 and fully enclose an interior area "A1" (FIG. 4A) within outer bag 102. As fully formed, outer bag 102 defines a generally tubular configuration, although other configurations are also contemplated. In embodiments the short edges 120 are closed by other mechanical means including, but not limited to, hook and loop fastener systems, adhesives (flexible or rigid), permanent or non-permanent snap strips, permanent or non-permanent individual snaps, heat seals (e.g., heat press or laser seals), or combinations thereof.

With continued reference to FIGS. 1 and 2, the sheet of material forming outer bag 102 may be a woven polyethylene cloth. The sheet of material forming the outer bag 102 may be water-permeable such that the material is capable of being permeated by water. Woven polyethylene cloth is advantageous in that it is strong, durable, weather-proof, water and mildew resistant, easy to clean, non-water absorbent, drainable, and resists UV-degradation. Other suitable materials for forming the sheet of material of outer bag 102 are also contemplated including, but not limited to, woven nylon from 400 to 1,000 denier (both coated and non-coated), polyethylene/nylon blends, vinyl (both coated and non-coated), imitation leather, leather, etc. As can be appreciated, these materials define relatively smooth, non-abrasive surfaces to inhibit catching and/or scratching during use of fitness training bag 10.

Body 100 of fitness training bag 10 may define various different sizes, depending upon a particular purpose, e.g., the size and/or strength of the user, the exercises to be performed, etc. More specifically, it is contemplated that multiple fitness training bags 10 of different sizes and weights be provided for various different users and/or purposes, for example:

- an extra small bag having a length of between 5 and 26 inches and a height of between 5 and 9 inches;
- a small bag having a length of between 26 and 46 inches and a diameter of between 11 and 13 inches;
- a medium bag having a length of between 32 and 52 inches and a diameter of between 13 and 15 inches;
- a large bag having a length of between 32 and 52 inches and a diameter of between 15 and 17 inches;
- an extra-large bag having a length of between 34 and 54 inches and a diameter of between 17 and 19 inches;
- an extra-long bag having a length of between 54 and 96 inches and a diameter of between 14 and 17 inches.

Other size bags are also contemplated. Further, each of the fitness training bags 10 may define a weight of between 1 and 200 lbs. More specifically, the set of fitness training bags 10 may define a range of weights in equal or varied increments, and/or multiple fitness training bags 10 in each size may be provided, each having a different weight (due to different internal configurations thereof, as detailed below).

Referring still to FIGS. 1 and 2, first and second handles 210, 220 are engaged to upper portion 112 of outer bag 102 of body 100 and extend therefrom, although it is envisioned that greater or fewer handles, and/or handles of different configuration may also be provided. In some embodiments, handles need not be provided. First and second handles 210, 220 are sewn to upper portion 112 of outer bag 102 using a reinforced stitching pattern to ensure a secure engagement therebetween. First and second handles 210, 220 define looped configurations wherein the end segments 212, 222 thereof are sewn to upper portion 112 of outer bag 102 to define a loop opening 214, 224 within each handle 210, 220. Openings 214, 224 are configured for receipt of a user's fingers, hand, and/or arm, to facilitate lifting, carrying, manipulating, throwing, and/or dropping fitness training bag 10. More specifically, openings 214, 224 may each define a diameter between 3 inches and 9 inches. In some embodiments, openings 214, 224 are sufficiently large so as to receive the body of another fitness training bag therein, as will be detailed below with respect to FIG. 3E, and/or the handle of another fitness training bag, as will be detailed below with respect to FIG. 3F.

Handles 210, 220 are spaced-apart from one another a distance between 16 inches and 36 inches, more specifically, between 22 inches and 30 includes, or, even more particularly, 26 inches. It has been found that 26 inches is the target ergonomic spacing of handles 210, 220 for the average person to grasp fitness training bag 10 with arms at shoulder-width apart; however, other distances within the above-noted ranges may alternatively be provided, depending upon the size and/or preference of the user or for a particular purpose. Further, other configurations of handles are also contemplated, such as those detailed below with respect to FIGS. 3A and 3B.

Handles 210, 220 may be made from a nylon webbing with UV treatment. Alternatively, handles 210, 220 may be made from polypropylene webbing, polyester webbing, or leather. These materials are advantageous in that they are strong, durable, weather-proof, water and mildew resistant, easy to clean, non-water absorbent, and resist UV-degradation. Further, by forming handles 210, 220 from such materials, handles 210, 220 are floppy, so as not to interfere with lifting, throwing, dropping, or otherwise manipulating fitness training bag 10 when not being grasped by handles 210, 220.

Figure 3A:
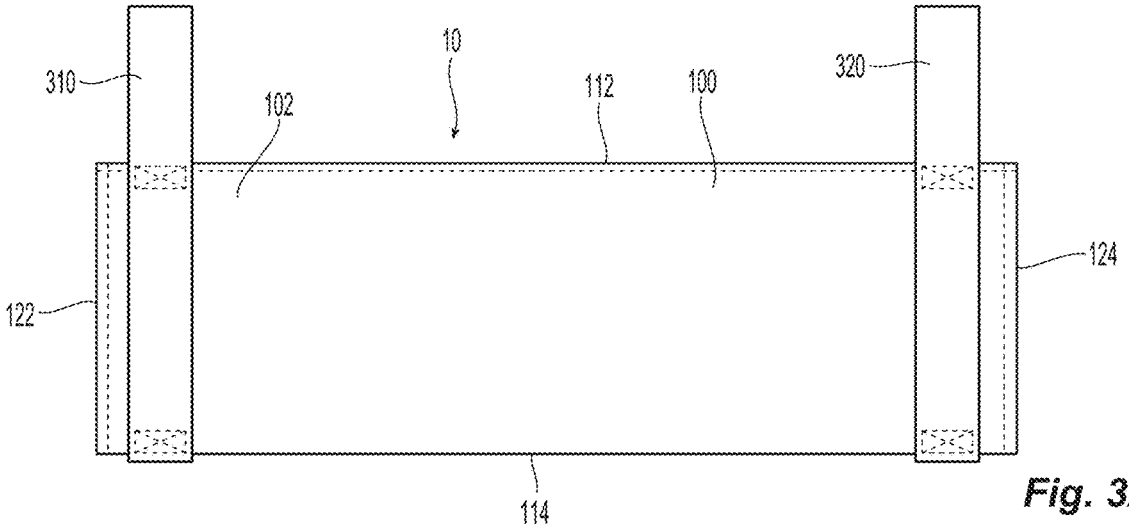
FIG. 3A is a side view of the fitness training bag of FIG. 1 including another configuration of handles.

Turning now to FIG. 3A, in another embodiment of the fitness training bag 10, handles 310, 320 extend around the outer peripheral circumference of outer bag 102 of body 100. Handles 310, 320 are secured about body 100 via reinforced stitching at various locations around the peripheral circumference of outer bag 102 of body 100 and extend from upper portion 112 thereof to define looped portions 312, 322 of handles 310, 320, respectively. As can be appreciated, having handles 310, 320 extend around the outer peripheral circumference of outer bag 102 of body 100 provides greater strength to the engagement between handles 310, 320 and outer bag 102. Handles 310, 320 may otherwise be configured similar to handles 210, 220, detailed above with respect to FIGS. 1 and 2.

Figure 3B:
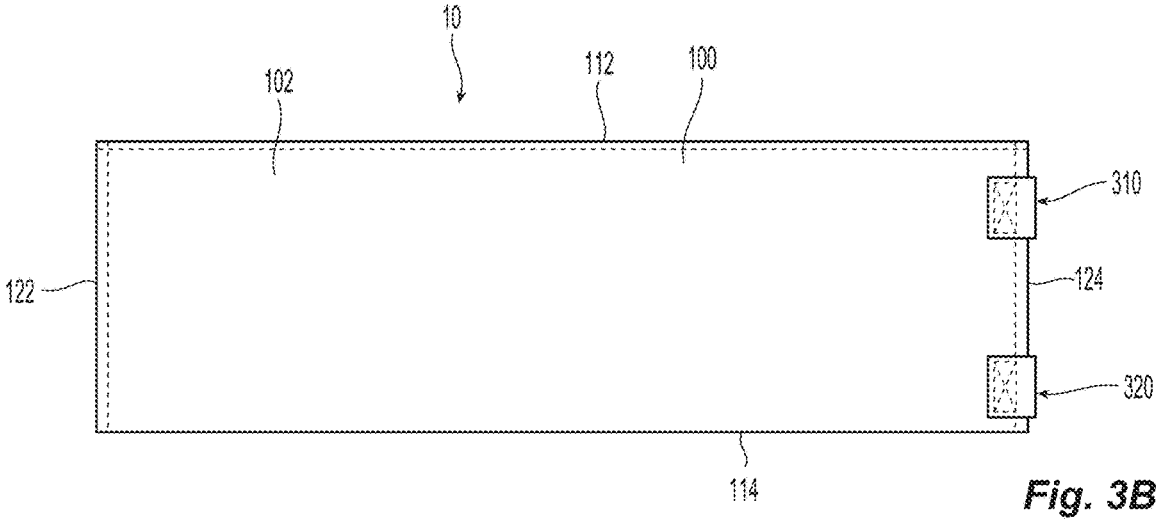
FIG. 3B is a side view of the fitness training bag of FIG. including another configuration of handles.

With reference to FIG. 3B, in another embodiment of the fitness training bag 10, handles 410, 420 are engaged to one of the end portions 122, 124 of body 100, e.g., end portion 124, although handles 410, 420 engaged to both end portions 122, 124 are also contemplated. In the embodiment of FIG. 3B, handles 410, 420 are configured as low-profile straps wherein the ends thereof are secured to outer bag 102 of body 100 of fitness training bag 10 at spaced-apart positions along end portion 124 thereof (as an alternative to the looped configurations of handles 210, 220 which are secured together to outer bag 102 (FIGS. 1 and 2)). In use, a user can grasp the free, central portion of either or both of handles 410, 420 to enable manipulation of training bag 10. As an alternative to strap-style handles, handles 410, 420 may be configured as loop handles such as those detailed above with respect to handles 210, 220, and vice versa; or both loop and strap-style handles may be provided. The length of handles 210, 220 may each be between 6 and 20 inches.

Figure 3C:
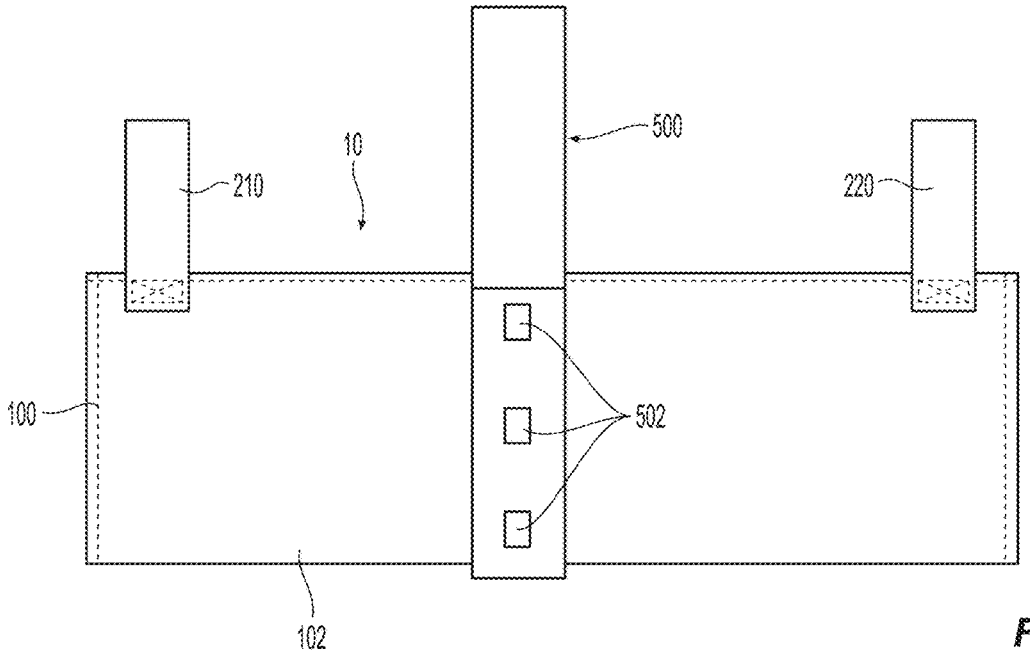
FIG. 3C is a side view of the fitness training bag of FIG. 1 including a releasable handle engaged therewith.

Turning to FIG. 3C, fitness training bag 10 may further be configured for use with one or more removable handles 500. Removable handle 500 is configured to extend about the peripheral circumference of outer bag 102 of body 100 and may be secured in position via one or more releasable securement members 502, e.g., buttons, snaps, hook and latch engagements, buckles, etc. Depending upon the exercise to be performed, the number and/or positioning of removable handle 500 may be altered to define a desired configuration. For example, it is contemplated that removable handle 500 may be selectively positioned anywhere on the bag depending upon a person's size or a particular exercise routine. Moreover, personal removable handles may be separately manufactured for use with different bags. As can be appreciated this has tremendous benefits over other known bags since a user can use his or her own handles 500 for each bag and for each exercise eliminating obvious health concerns with multiple users of gym equipment (hygiene, bacteria, etc.).

Removable handles 500 may be secured by the user in any known fashion at specific location (e.g., snap fit) or may be slidingly secured to allow the user to move the handles 500 along any side of the outer bag 102. Handles 500 may be easily removed and re-attached as needed. Handles 500 may also be easily sterilized or washed after each use.

Figure 3D:
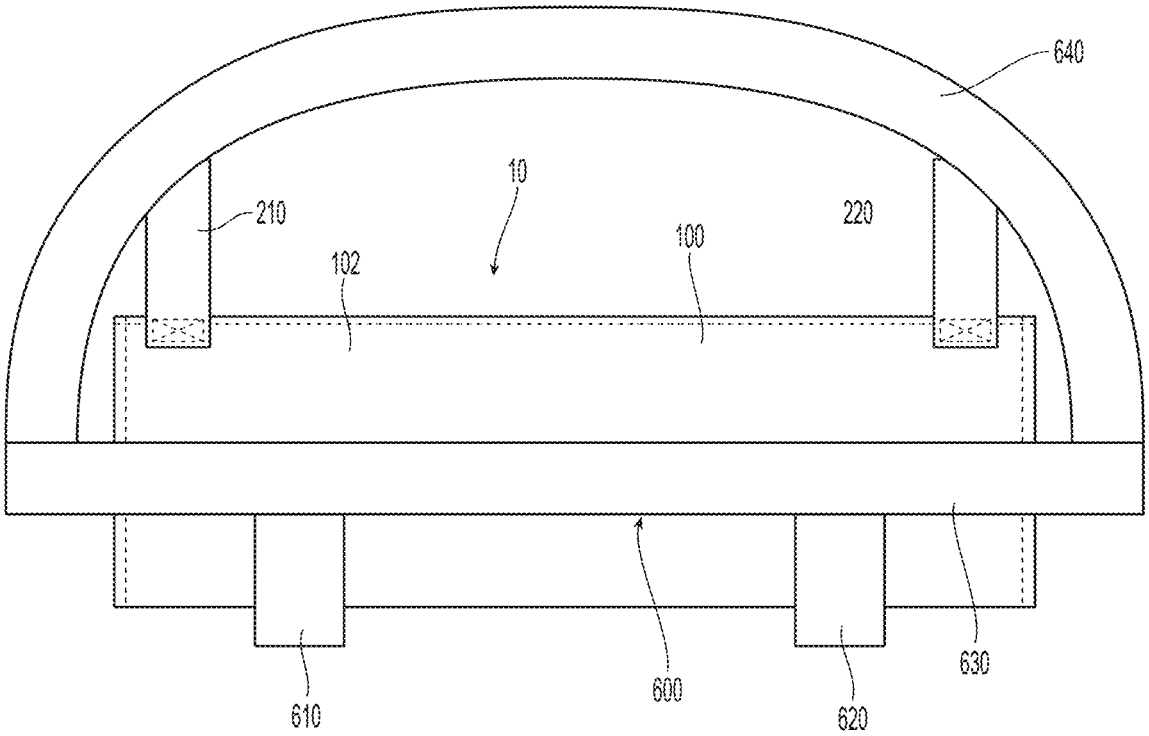
FIG. 3D is a side view of the fitness training bag of FIG. 1 including a carrying harness engaged therewith.

As shown in FIG. 3D, fitness training bag 10 may include a carrying harness 600 facilitating transport of fitness training bag 10. Carrying harness 600 includes a pair of semi-annular strap portions 610, 620 configured to extend semi-annularly about the circumference of body 100 of fitness training bag 10 adjacent lower portion 114 thereof, a long strap portion 630 configured to extend longitudinally about body 100 of fitness training bag 10, and a carrying strap portion 640 extending from long strap portion 630 adjacent each end portion 122, 124 of body 100 of fitness training bag 10. As can be appreciated, carrying harness 600 can be readily slipped into position about body 100 of fitness training bag 10. Once carrying harness 600 is disposed about body 100 of fitness training bag 10, carrying strap portion 640 may be utilized to facilitate transport thereof. Other suitable configurations of carrying harnesses are also contemplated.

Figure 3E:
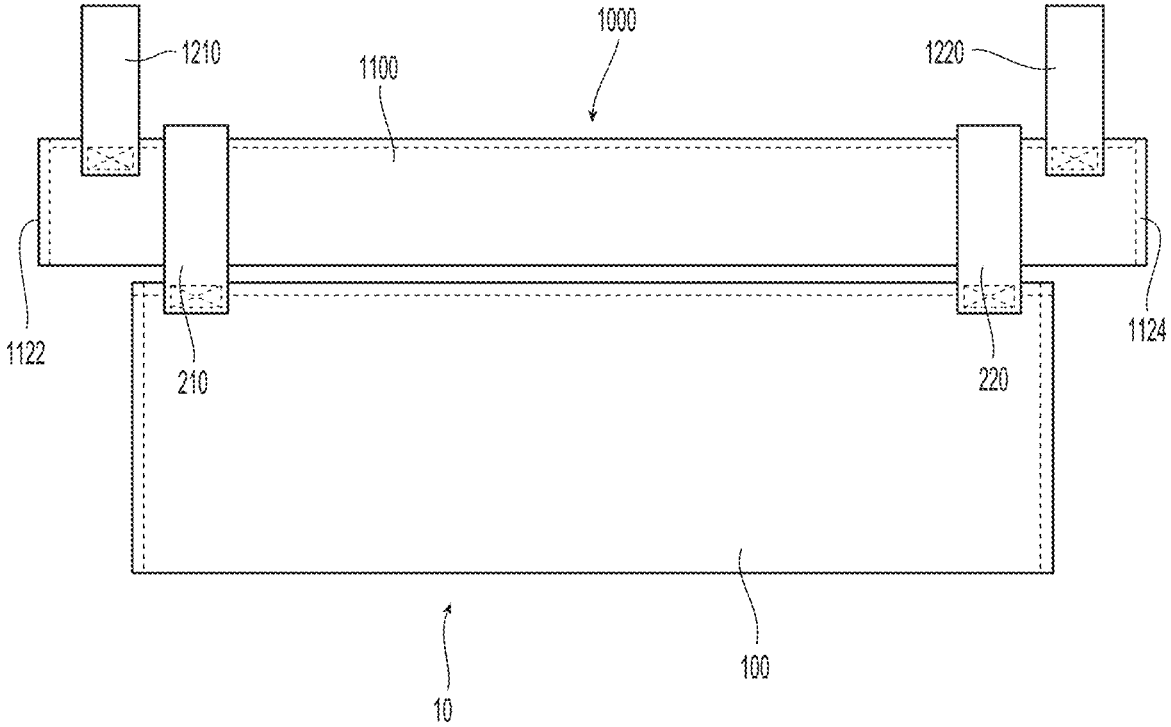
FIG. 3E is a side view of the fitness training bag of FIG. 1 supporting another fitness training bag for tandem use.

Referring to FIG. 3E, as noted above, in some embodiments, openings 214, 224 defined through handles 210, 220 are configured to enable receipt of the opposed end portions 1122, 1124 of body 1100 of another fitness training bag 1000 to enable tandem use thereof. As illustrated in FIG. 3E, fitness training bag 1000 is manipulated relative to fitness training bag 10 such that handles 1210, 1220 of fitness training bag 1000 are disposed outwardly of handles 210, 220 of fitness training bag 10. In this configuration, grasping handles 1210, 1220 during use helps ensure that body 1100 of fitness training bag 1000 remains disposed within openings 214, 224 defined through handles 210, 220 of fitness training bag 10 and, thus, that bags 10, 1000 remain coupled to one another during tandem use. However, other configurations are also contemplated.

Figure 3F:
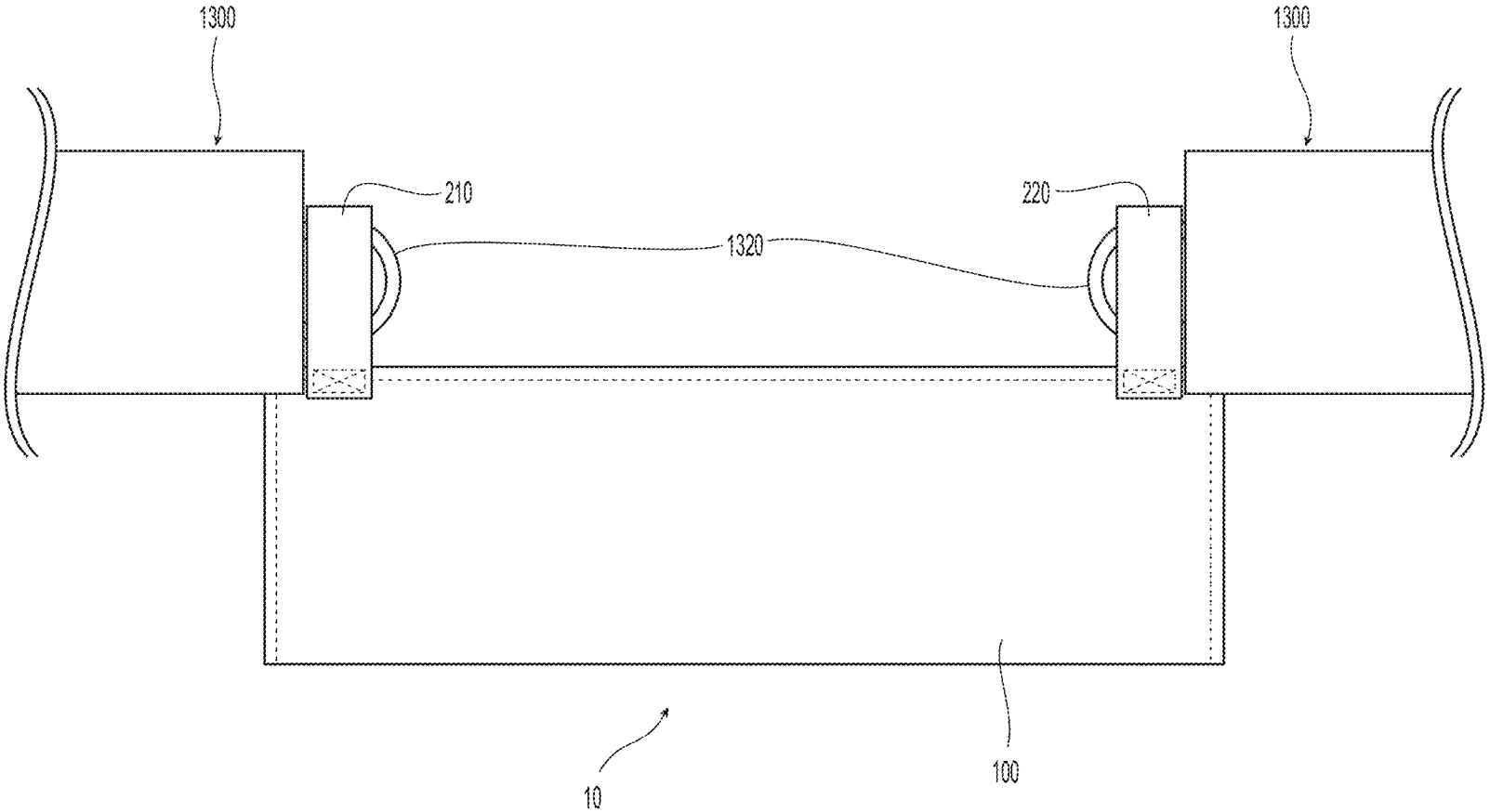
FIG. 3F is a side view of the fitness training bag of FIG. 1 supporting a pair of other fitness training bags for multi-bag use.

With reference to FIG. 3F, another configuration of multi-bag use is detailed. More specifically, a pair of fitness training bags 1300 are positioned such that the handle(s) 1320 of each fitness training bag 1300 extends through one of the openings 214, 224 defined through handles 210, 220 of fitness training bag 10. In this configuration, grasping handles 1320 of fitness training bags 1300 during use retains handles 210, 220 of fitness training bag 10 between the user's hands and body 1310 of fitness training bag 1300, thus helping to ensure that fitness training bags 1300 and fitness training bag 10 remain coupled to one another during use. Fitness training bags 1300 may be configured similar to the fitness training bag 10 illustrated in and described with respect to FIG. 3A, may be configured similar to any of the other fitness training bags detailed herein, or may define any other suitable configuration.

Figure 3G:
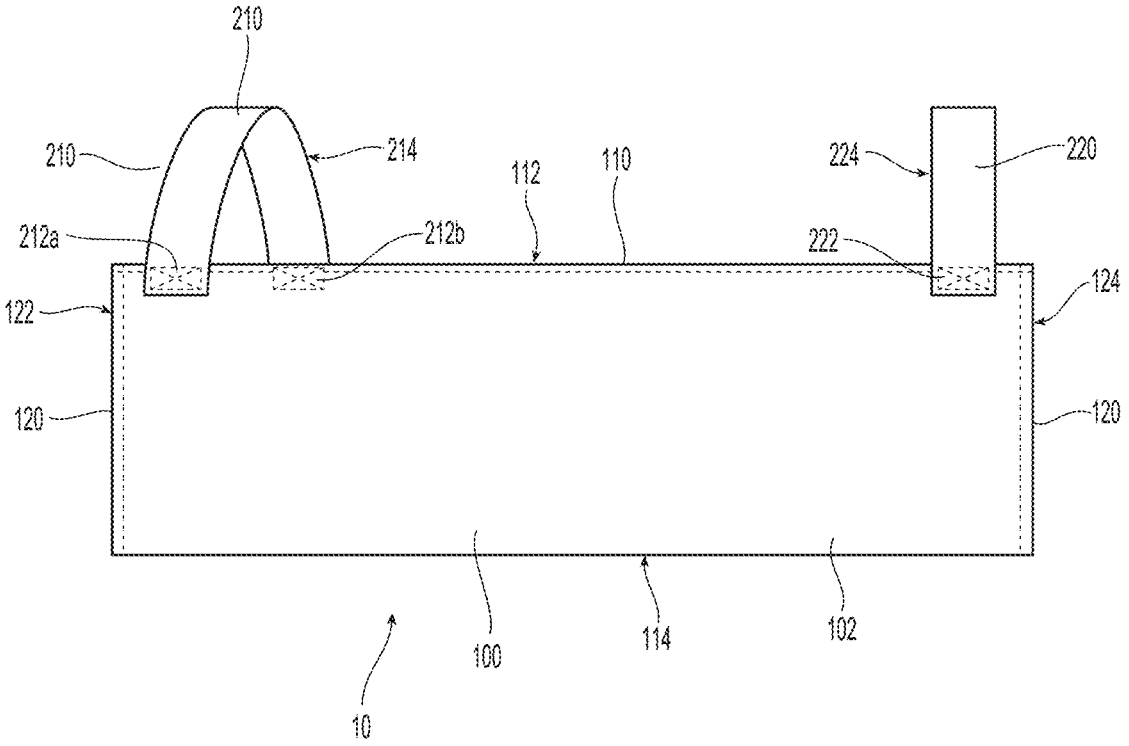
FIG. 3G is a side view of the fitness training bag of FIG. 1 with handle having a "rainbow" configuration.

Referring to FIG. 3G, the end segments 212*a*, 212*b* of the first handle 210 may be longitudinally offset from one another along the upper portion 112 of the outer bag 102 such that the first handle 210 has a "rainbow" configuration. Specifically, the end segment 212*a* of the first handle 210 may be closer to the end portion 122 than the end segment 212*b* of the first handle 210. The end segment 212*a* may be longitudinally offset from the end segment 212*b* in a range of about zero inches to about six inches. However, in some embodiments, the end segment 212*a* is longitudinally offset from the end segment 212*b* more than six inches. It is contemplated that handles having a "rainbow" configuration may allow a user to more quickly grab the handle when compared to a traditional handle where the end segments 212*a*, 212*b* are not offset from one another. This may be advantageous in a timed competition and/or training. Additionally or alternatively, handles having a "rainbow" configuration may improve a weight or force distribution on the outer bag 102 when the first handle 210 is grabbed by a user. In some embodiments, both the first and second handle 210, 220 have a "rainbow" configuration. In such embodiments, the end segments, e.g., end segments 212*a*, 222, of each of the first and second handles 210, 220 on one side of the outer bag 102 may be closer to the end portion 122 or the end segments on one side of the outer bag 102 may be closer to the closest end portion, e.g., end portion 122 or end portion 124.

Figure 4A:
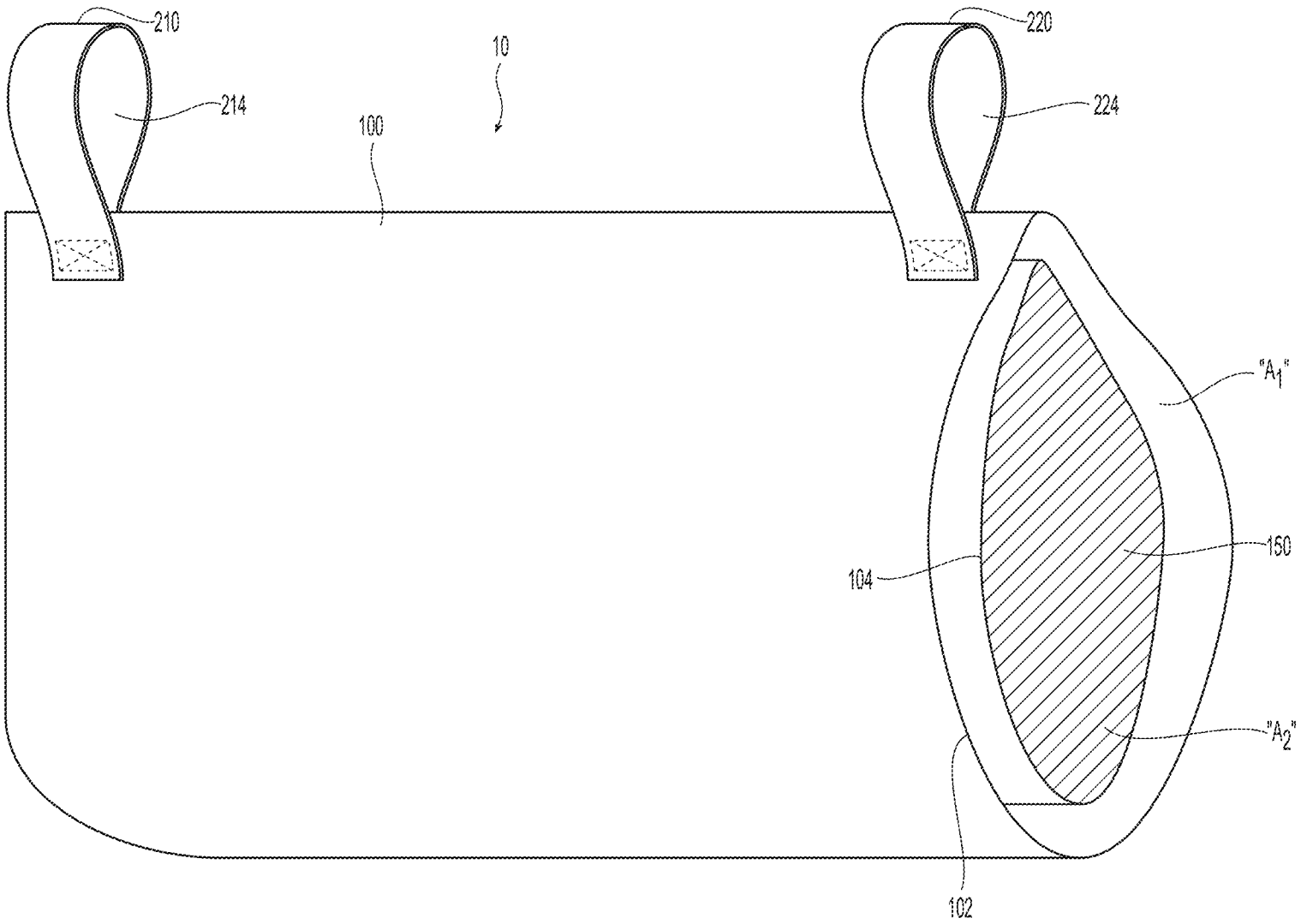
FIG. 4A is a perspective, partial cross-sectional view of the fitness training bag of FIG. 1 illustrating the internal configuration thereof.

Turning to FIG. 4A, as noted above, body 100 of fitness training bag 10 includes an outer bag 102 that fully encloses an interior area "A1" therein. Disposed within the interior area "A1" of outer bag 102 is an inner bag 104. Inner bag 104 may be formed from a non-woven polypropylene or polyethylene material having a fabric weight of between 8 ounces and 10 ounces. Other materials for forming inner bag 104 are also contemplated, as are other fabric weights thereof, e.g., between 2 ounces and 14 ounces.

Inner bag 104 fully encloses an interior area "A2" therein for retaining a filler 150 within inner bag 104. More specifically, inner bag 104 may be formed in a similar manner as detailed above with respect to outer bag 102, although other manufacturing techniques are also contemplated. The above-detailed materials forming and configuration of inner bag 104 is such that inner bag 104 is water-permeable and allows for drainage, is sufficiently dense to inhibit leakage of the filler 150 therefor, and provides a relatively high tensile strangle to inhibit ripping, tearing, or otherwise damaging inner bag 104.

Filler 150 is a composition of individual pieces of material that cooperate to form a filler 150 that is non-absorbent, drainable, non-packable, resiliently compressible, inert to insects and animals, and durable. A non-absorbent, drainable filler 150 allows for fitness training bag 10 to be utilized in adverse weather conditions without the worry of altering the weight of fitness training bag 10 or damaging fitness training bag 10, e.g., via mildew or mold growth. A non-packable, resiliently compressible filler 150 provides flexibility to fitness training bag 10 and allows for some "bounce," thus making fitness training bag 10 more comfortable, manipulatable, and cushioning (shock-absorbing).

In order to achieve the above-noted properties, filler 150 may include a composition of individual pieces of chopped and/or crushed rubber sized in the range of 1/32 inches to 1 inch. In some embodiments, to facilitate environmental friendliness, the rubber is scrap material from the manufacture of molded shoe soles, such as those sold under the trademark Vibram® and produced by Quabaug Corporation of North Brookfield, Mass., USA. However it is additionally or alternatively envisioned that filler 150 may be made from scrap and/or recycled material from other rubber sole manufactures and/or other products such as, for example, tires, plastic pellets, pea-stone, steel shot, and combinations thereof. In embodiments, the filler 150 is a mixture of rubber sole scrap material of different densities, e.g., three different densities corresponding to three different types of rubber soles, although material of uniform density may also be utilized.

To achieve a desired weight of fitness training bag 10, as can be appreciated, the composition thereof may be altered, e.g., via using different materials (such as those detailed above) or mixtures thereof. For example, where a heavier bag 10 is desired, filler 150 may include a mixture of rubber sole scrap and plastic pellets having a specific gravity between 1.0 and 1.8. Such plastic pellets may be talc filled polyethylene and/or talc filled polypropylene pellets, although other suitable materials are also contemplated.

Additionally or alternatively, a desired weight of fitness training bag 10 may be achieved by altering the amount of filler 150 utilized. It is envisioned that inner bag 104 be selected such that the interior area "A2" thereof is suitable for retaining the desired amount of filler 150 at 75% to 100% capacity by volume to inhibit large shifts in the filler 150 within inner bag 104 during use, although other fill percentages are also contemplated. Likewise, outer bag 102 is only slightly larger than inner bag 104 so as to inhibit substantial shifting or movement of inner bag 104 during manipulation of fitness training bag 10. Inner bag 104 may further be sewn to outer bag 102 to retain the position thereof.

Figure 4B:
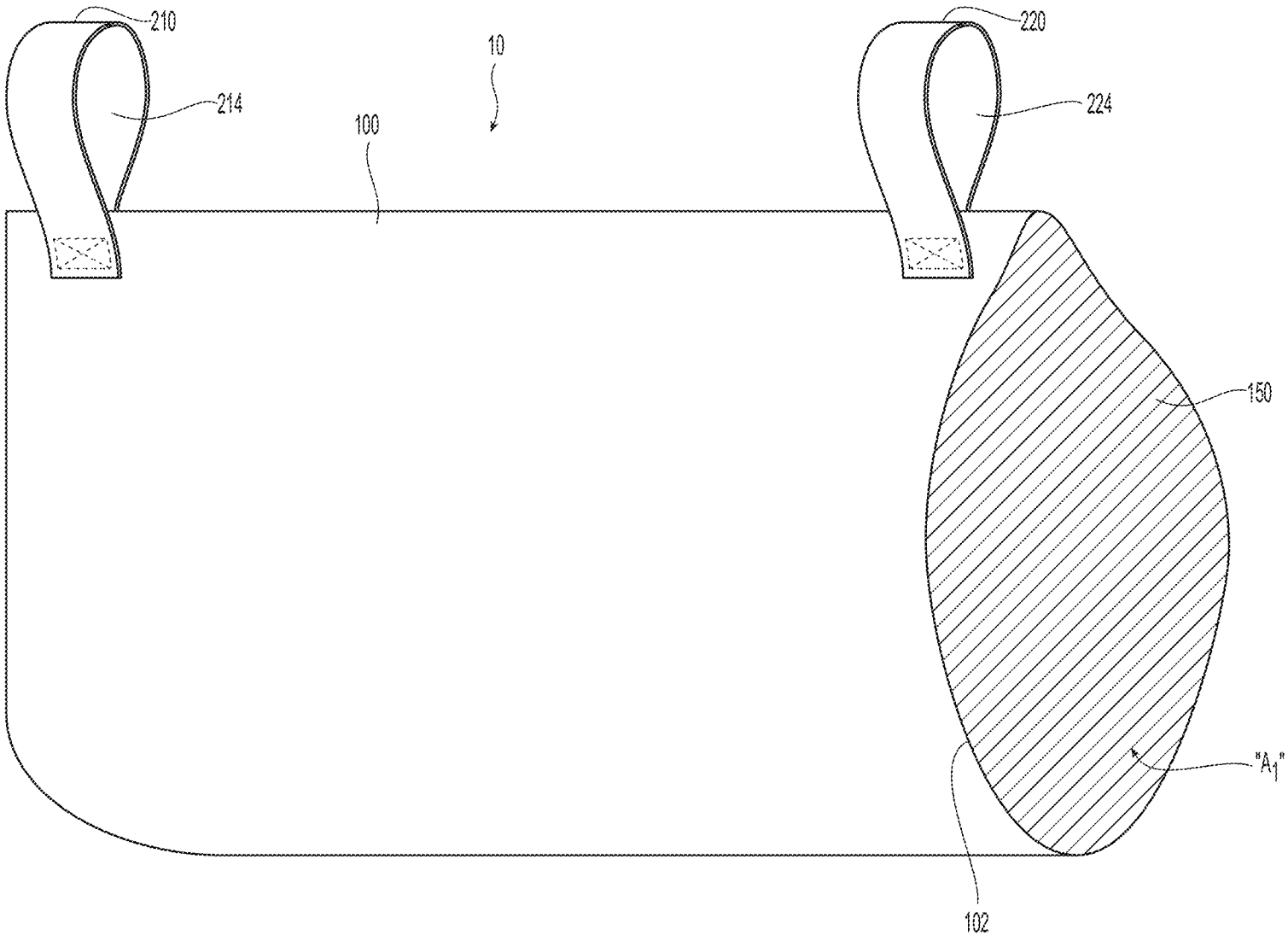
FIG. 4B is a perspective, partial cross-sectional view of another fitness training bag similar to the fitness training bag of FIG. 1 except for the internal configuration thereof.

Referring to FIG. 4B, in other embodiments, inner bag 104 (FIG. 4A) is eliminated and filler 150 occupies interior area "A1" of outer bag 102. In such embodiments, the material forming outer bag 102 is selected to be sufficiently-tightly woven so as to inhibit the escape of filler 150 therethrough. Alternatively, inner bag 104 (FIG. 4A) may still be provided and the interior area "A2" thereof retaining a first filler 150, while the interior area "A1" of outer bag 102 that surrounds inner bag 104 (FIG. 4A) retains a second filler 150 therebetween. First and second fillers 150 may be similar or different, and may be formed, sized, and/or configured in any of the manners detailed above.

Figure 4C:
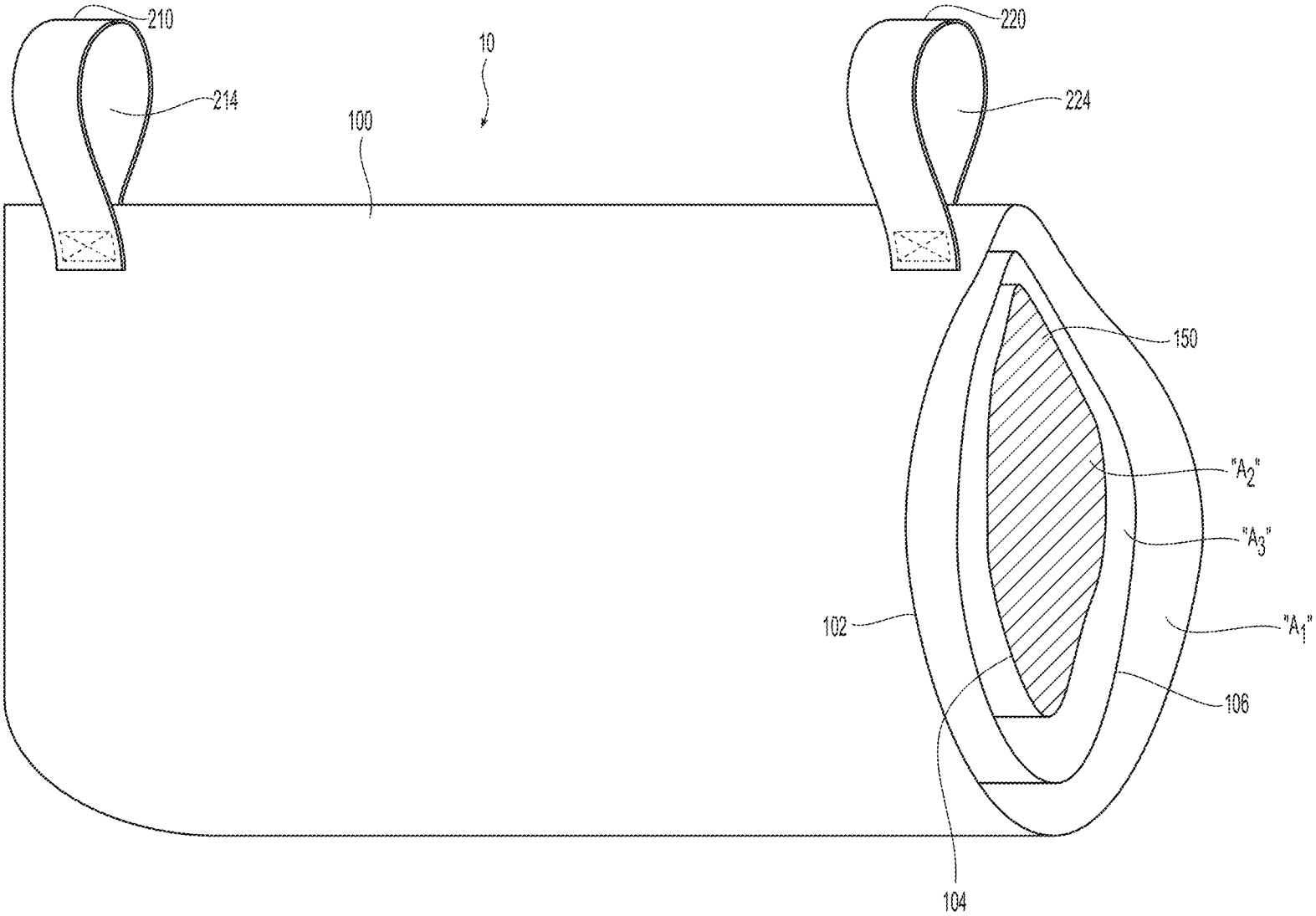
FIG. 4C is a perspective, partial cross-sectional view of another fitness training bag similar to the fitness training bag of FIG. 1 except for the internal configuration thereof.

Referring to FIG. 4C, in still other embodiments, an intermediate bag 106 is provided between outer bag 102 and inner bag 104. Intermediate bag 106 may be formed in a similar manner as detailed above with respect to outer bag 102, although other manufacturing techniques are also contemplated. Intermediate bag 106 may be formed from a non-woven polypropylene or other material and is configured to serve as an additional cushioning layer. Intermediate bag 106 may be sewn about its perimeter to outer bag 102, inner bag 104, or may be free-floating therebetween. Intermediate bag 106 defines an interior area "A3" that may be filled with a third filler 150 (with or without interior area "A1" of outer bag 102 including second filler 150 disposed therein). The intermediate bag 106 may be formed from a water-permeable material.

Figure 5:
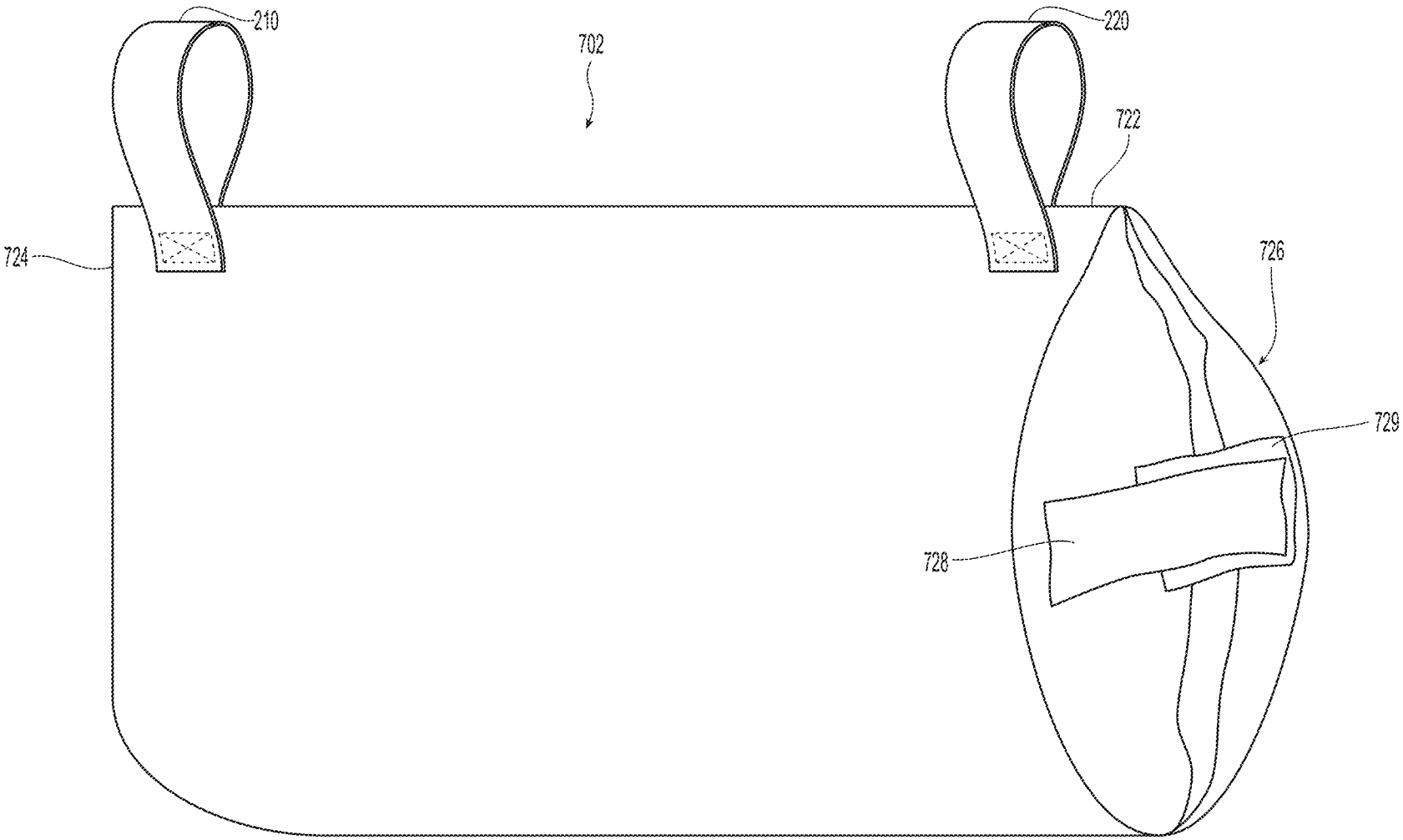
FIG. 5 is a perspective, partial cross-sectional view of an outer bag similar to the outer bag of the fitness training bag of FIG. 1 in accordance with the present disclosure.

With reference to FIG. 5, an outer bag 702 is provided in accordance with the present disclosure. The outer bag 702 is similar to the outer bag 102 detailed above with similar elements represented with a similar label with a "7" replacing the leading "1" of the previous label. As such, only the differences will be detailed herein for brevity. The outer bag 702 may include a first handle and/or a second handle, e.g., first and/or second handles 210, 220. The outer bag 702 may be formed from a material similar to outer bag 102 detailed above. The outer bag 702 may be provided in a variety of sizes.

The outer bag 702 includes end portions 722, 724. At least one of the end portions 722, 724 includes a reusable closure mechanism 726 that allows for the respective end portion 722, 724 to be selectively opened and closed. In some embodiments, end portion 722 is stitched closed in a similar manner to the end portion 122 detailed above and the end portion 724 includes the reusable closure mechanism 726. In another embodiment, end portions 722, 724 each include a closure mechanism 726.

The reusable closure mechanism 726 closes the end portion, e.g., end portion 722, such that an interior of the outer bag 702 is closed to secure one or more inner bags therein. The reusable closure mechanism 726 may include first and second closure straps 728, 729 that selectively close the respective end portions 722, 724 of the outer bag 702. The first and second closure straps 728, 729 may be tied together, secured together with a fastener system, secured together with a hook and loop fastener system, looped through an opening of the outer bag 702, stitched through a plurality of openings in the end portion of the outer bag 702, or secured together by another method to securely close the respective end portion 722, 724 of the outer bag 702. For example, the first closure strap 728 may include a hook and loop fastener system and the second closure strap 729 may include a loop such that the first closure strap 728 is configured to pass through the loop and secure to itself by the hook and loop fastener system to selectively close the respective end portion 722, 724. In embodiments, other mechanical closure systems are contemplated such has zippers, button snaps (permanent and non-permanent), snap strips (permanent and non-permanent), hook and loop fastener systems on the edges, buckles (fabric or plastic, buttons, pin and loop, adhesives, and combinations thereof.

The outer bag 702 may be provided as a replacement for an outer bag, e.g., outer bag 102, of a fitness training bag 10 (FIG. 1) that has become worn and/or damaged. In such applications, an end portion of an outer bag to be replaced is opened. In some embodiments, an end portion of the outer bag to be replaced is cut open and contents of an interior of the outer bag to be replaced are moved into the interior of the outer bag 702 and the end portions 722, 724 are closed. In some embodiments, a closure mechanism of an outer bag to be replaced, e.g., closure mechanism 726, is opened and contents of an interior of the outer bag to be replaced are moved into the interior of the outer bag 702 and the end portions 722, 724 are closed.

In some embodiments, the outer bag 702 allows for customization of the weight of a fitness training bag, e.g., fitness training bag 10 (FIG. 1). For example, one or more inner bags may be used to fill the interior of the outer bag 702 and the end portions 722, 724 may be secured to enclose the inner bags within the interior of the outer bag 702. The inner bags may be water-permeable or may be water-impermeable. It is contemplated that the inner bags may be filled with a filler material similar to the filler 150 detailed above or may be filled with sand.

Figure 6:
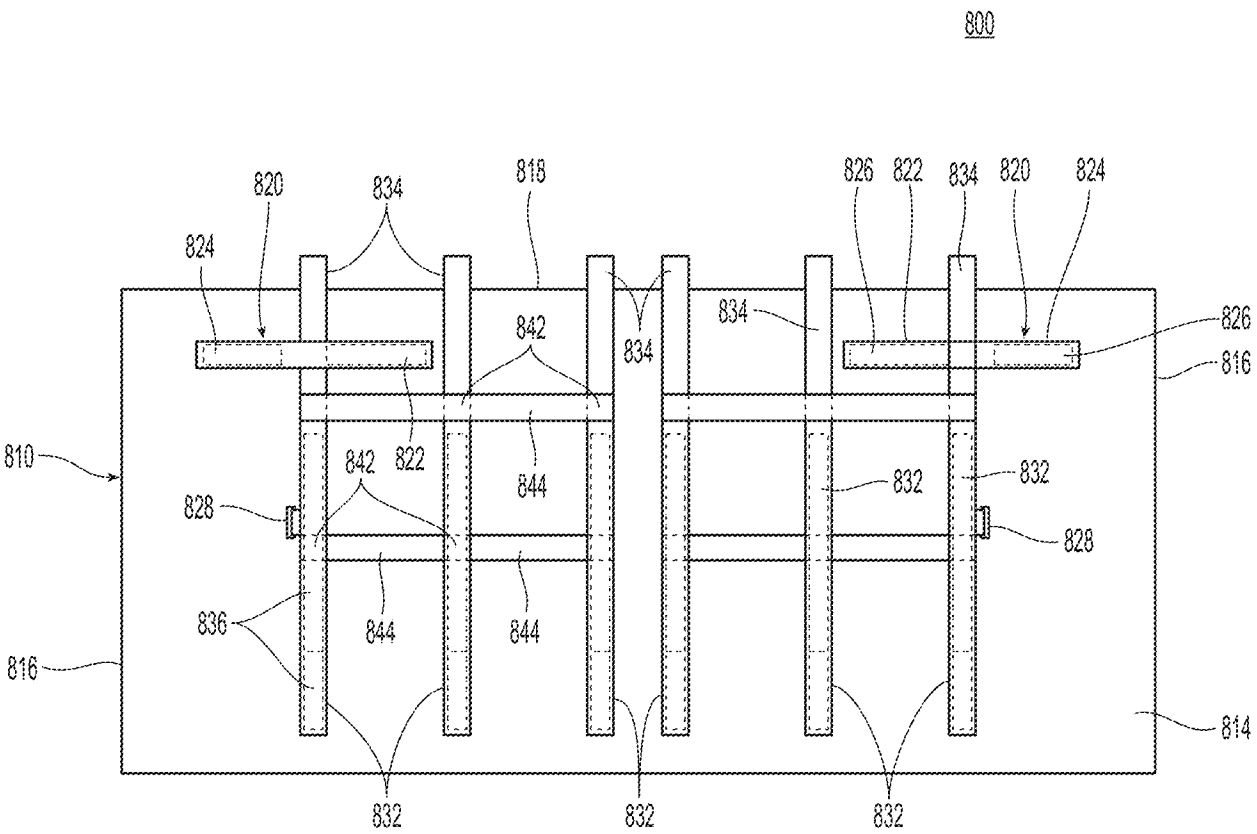
FIG. 6 is a top view of a bag wrap provided in accordance with the present disclosure.
Figure 7:
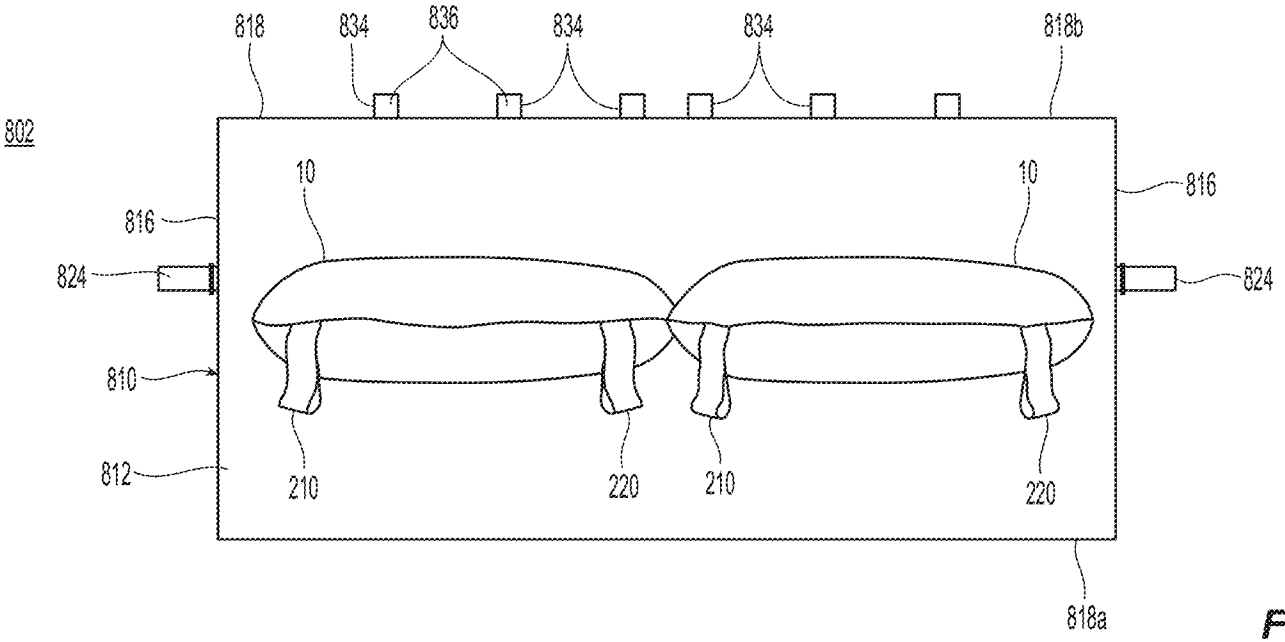
FIG. 7 is a top view of a wrap assembly including the bag wrap of FIG. 6 and two fitness training bags of FIG. 1 in an unwrapped configuration.
Figure 8:
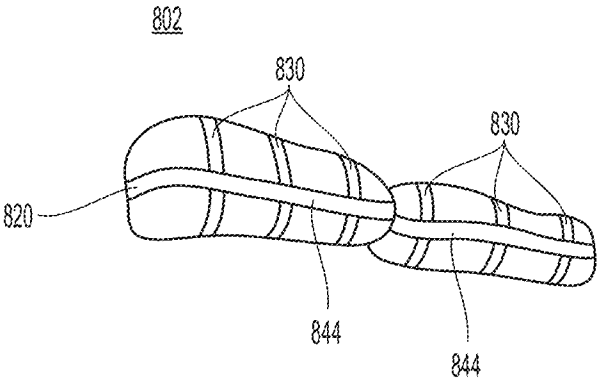
FIG. 8 is a perspective view of the wrap assembly of FIG. 7 in a wrapped configuration.

With reference to FIGS. 6-8, a bag wrap 800 is provided in accordance with the present disclosure to secure two or more fitness training bags, e.g., fitness training bags 10, together in a wrap assembly 802. The bag wrap 800 includes a body 810 in the form of a substantially rectangular sheet of material. The material of the body 810 may be similar to the material of the outer bag 102 (FIG. 1). The body 810 is sized to envelope two or more fitness training bags 10 placed end to end with one another. The body 810 may have a liner 812 on an inner surface body 810 that provides additional structure to the wrap assembly 802.

The body 810 has an outer surface 814 including end straps 820, securement straps 830, and holding straps 840. The end straps 820 are arranged to run along a length of the body 810 and in a direction substantially parallel to a longitudinal axis of the fitness training bags 10. The body 810 includes an end strap 820 adjacent each end 816 of the body 810. Each end strap 820 includes an attached portion 822 and a free portion 824. The attached portions 822 are secured to the body 810 by stitching or adhering to the outer surface 814 of the body 810. The free portion 824 extends from the attached portion 822 towards an end 816 of the body 810. The free portion 824 may include part of a fastener system 826 on an outer surface thereof and the attached portion 822 may have a complementary portion of the fastener system 826 on an outer surface thereof. The fastener system 826 may be a hook and loop fastener system. The outer surface 814 may include an end loop 828 adjacent each end 816 that is secured to the outer surface 814 of the body 810. As detailed below, the free portion 824 may be passed through the end loop 828 and secured to the attached portion 822 by the fastener system 826 to close the end 816 of the body 810.

The securement straps 830 are arranged in a direction substantially transverse to a length of the body 810 such that each of the securement straps 830 is arranged in a direction substantially perpendicular to the end straps 820. Each of the securement straps 830 has one or more attached sections 832 that are secured to the body 810 by stitching or adhering to the outer surface 814 of the body 810. Each of the securement straps 830 also has a free section 834 that extends from the attached section 832 towards an edge 818 of the body 810. The free section 834 may include part of a fastener system 836 on an inner surface thereof and the attached sections may include a complementary part of the fastener system 836 on an outer surface thereof. As detailed below, when the body 810 is wrapped around the fitness training bags 10, the securement straps 830 are wrapped around the body 810 such that the free sections 834 are secured to the attached sections 832 by the fastener system 836 to secure the body 810 about the fitness training bags 10. As shown, the bag wrap 800 includes six securement straps 830; however, the bag wrap 800 may include between two and ten securement straps depending on the overall length and configuration of the bag wrap 800. The fastener system 836 may be a hook and loop fastener system.

The holding straps 840 are arranged in a direction along a length of the body 810 such that the holding straps 840 are substantially perpendicular to securement straps 830. Each of the holding straps 840 may pass between one or more of the securement straps 830. Each of the holding straps 840 have attached segments 842 that are secured to the outer surface 814 of the body by stitching or adhering to the outer surface 814 of the body 810. The attached segments 842 may be disposed between the outer surface 814 of the body 810 and one of the securement straps 830 such that the attached segments 842 are stitched to the outer surface 814 with the respective securement strap 830. Each holding strap 840 also includes one or more grasping segments 844 positioned between two attached segments 842. The grasping segments 844 allow for a hand or arm of a user to go between the holding strap 840 and the outer surface 814 of the body 810 to grasp the wrap assembly 802.

Continuing to refer to FIGS. 6-8, a method of forming the wrap assembly 802 is described in accordance with the present disclosure. Initially, the bag wrap 800 is laid out such that the outer surface 814 is against the ground or surface and the inner surface 812 is exposed as shown in FIG. 7. When the bag wrap 800 is laid out, the bag wrap 800 is substantially rectangular in shape. With the bag wrap 800 laid out, two or more fitness training bags 10 are laid end to end with one another on the inner surface 812 of the bag wrap 800 such that the fitness training bags 10 form a substantially cylindrical structure having a length equal to the sum of the length of each of the individual fitness training bags 10. As shown, each of the fitness training bags 10 has a similar length; however, each of the fitness training bags 10 may have a length different from one another.

With each of the fitness training bags laid end to end on the inner surface 812 of the bag wrap 800, a first edge 818*a* of the bag wrap 800 is wrapped around the fitness training bags 10 such that the inner surface 812 is tight against the fitness training bags 10. The second edge 818*b* is then wrapped over the first edge 818*a* and the fitness training bags 10 such that the free section 834 of each of the securement straps 830 engages the attached section 832 of the respective securement strap 830. Alternatively, the fitness training bags 10 may be laid end to end on the inner surface 812 adjacent the first edge 818*a* and the bag wrap 800 may be rolled over fitness training bags 10 until the second edge 818*b* is against the outer surface 814 and the free sections 834 of each of the securement straps 830 can be secured to the attached section 832 of the respective securement strap 830. With the free sections 834 secured to the attached sections 832, the bag wrap 800 is substantially cylindrical in shape and is tight about each of the fitness training bags 10 such that the fitness training bags 10 are fixed in end-to-end relationship with one another and are prevented from sliding next to one another.

The free portions 824 of each of the end straps 820 are then passed through the respective end loop 828 and then secured to the attached portion 822 of the respective end strap 820. When the fitness training bags 10 are wrapped inside of the bag wrap 800, the end loop 828 is approximately halfway across the cylindrical end of the bag wrap 800 such that the end straps 820 close the end of the bag wrap 800 and prevent the fitness training bags 10 from sliding out of the ends of the bag wrap 800. When the ends of the bag wrap 800 are closed by the ends straps 820, the bag wrap 800 and the fitness training bags 10 form a wrap assembly 802 which is substantially cylindrical or "cigar shaped" and prevents the fitness training bags 10 from dislodging from the end-to-end configuration. The liner 816 may provide additional structure to prevent the wrap assembly 802 from buckling at a joint between the ends of the fitness training bags 10.

In some embodiments, an end strap 820 of one bag wrap 800 may pass through an end loop 828 of another bag wrap 800 such that two bag wraps 800 are joined together to form a single wrap assembly, e.g., wrap assembly 802, which includes two or more bag wraps 800 and a plurality of fitness training bags 10.

As detailed above, the bag wraps 800 are not directly attached to the fitness training bags 10 while confining the fitness training bags 10 within the bag wraps 800. This may be advantageous in preventing damage to the fitness training bags when formed into a wrap assembly, e.g., wrap assembly 802. In addition, the method detailed above allows for one or more fitness training bags 10 to be quickly assembled into a wrap assembly 802 and can be reversed quickly to allow the one or more fitness training bags 10 to be used individually as desired.

Figure 10:
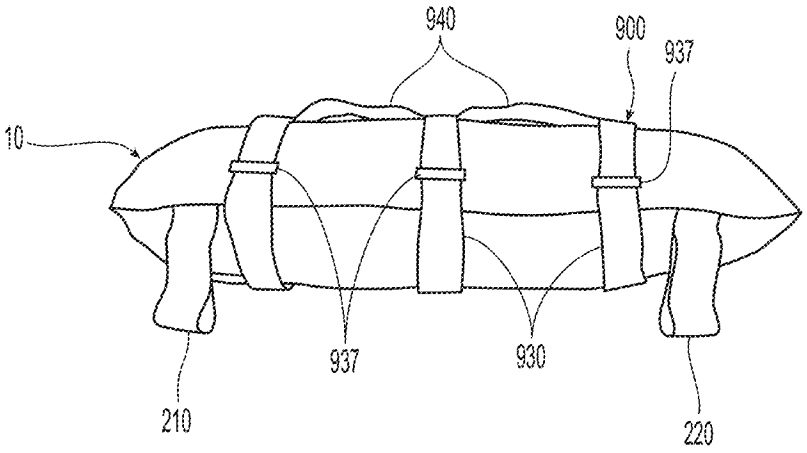
FIG. 10 is a side view of the rib system of FIG. 9 with the fitness training bag 10 of FIG. 1.
Figure 9:
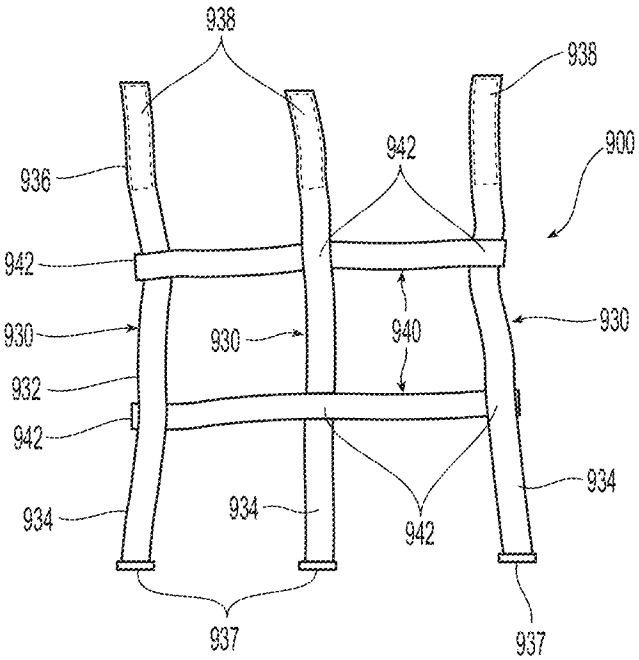
FIG. 9 is a top view of a rib system provided in accordance with the present disclosure.
Figure 11:
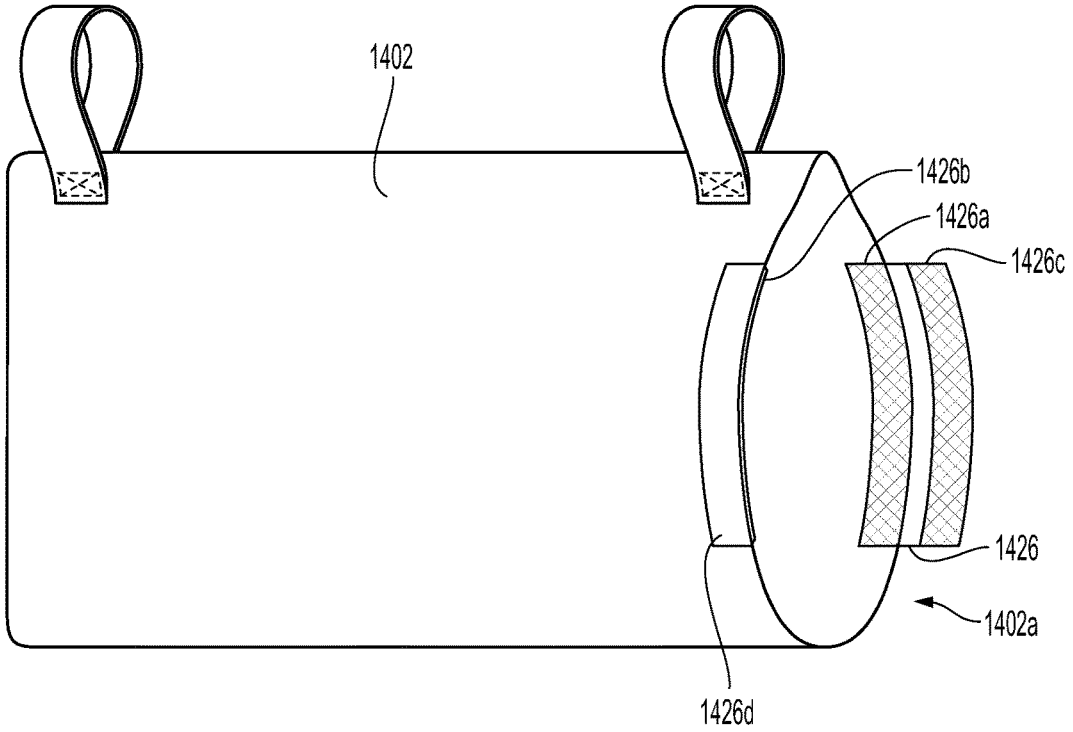
FIG. 11 is perspective view of another embodiment of a fitness training bag provided in accordance with the present disclosure.
Figure 12:
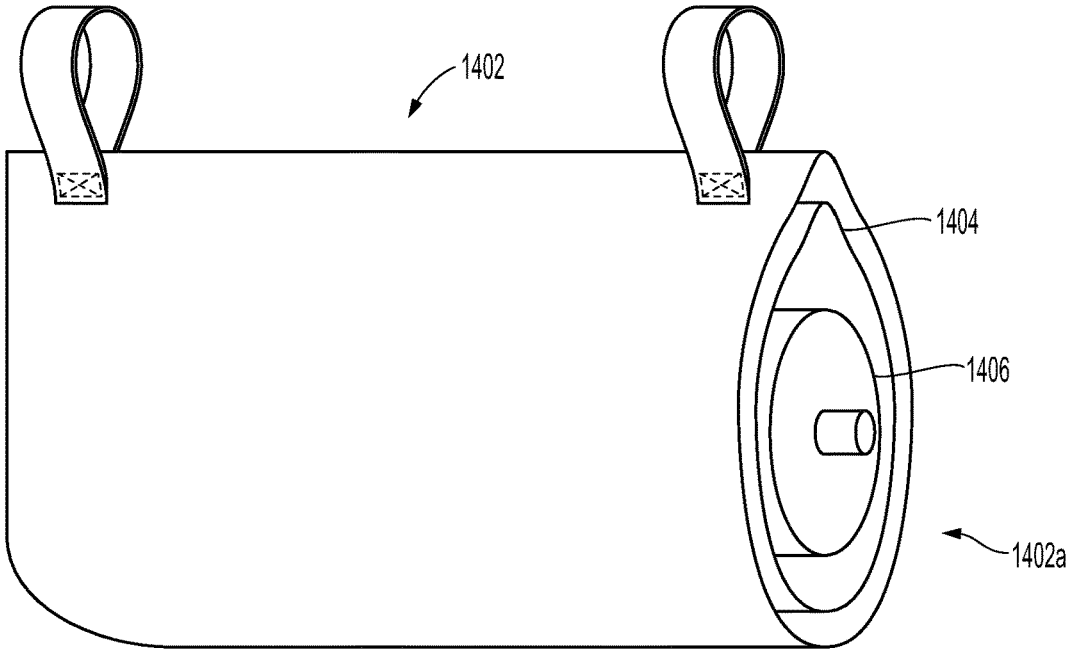
FIG. 12 is a perspective view of the fitness training bag of FIG. 11, shown with an end portion in an open position.
Figure 13:
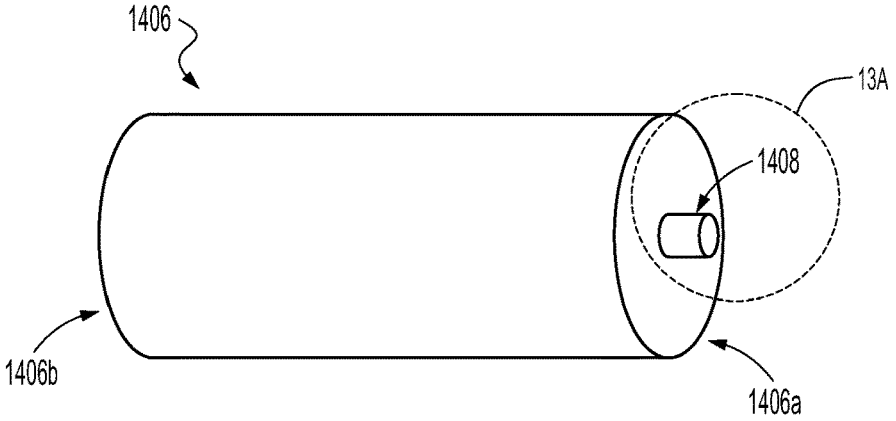
FIG. 13 is a perspective view of a bladder of the fitness training bag of FIG. 11.
Figure 13A:
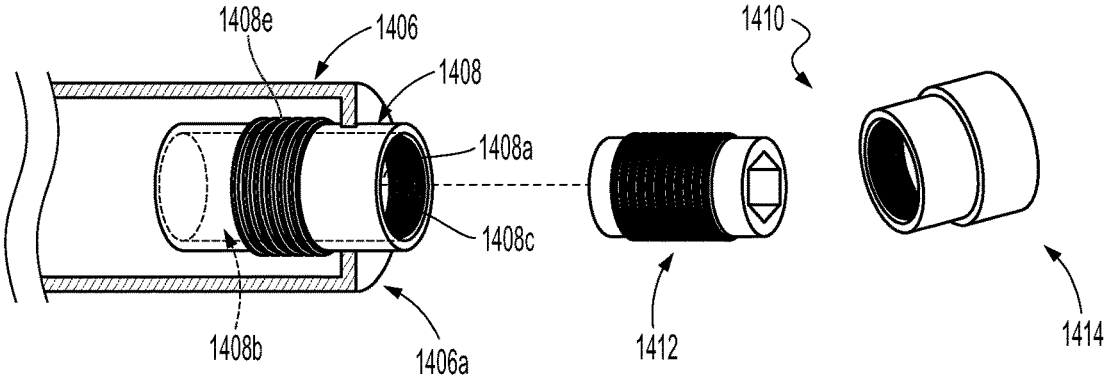
FIG. 13*a* is an enlarged view of the area of interest indicated in FIG. 13.
Figure 14:
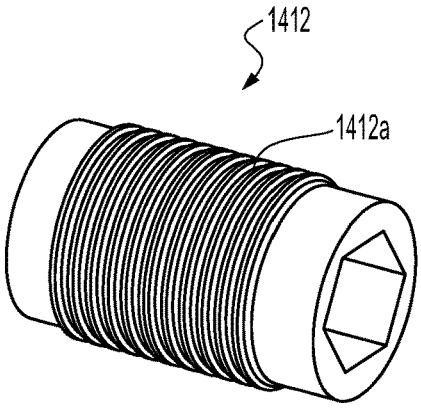
FIG. 14 is a perspective view of an inner closure plug of a fill port of the bladder of FIG. 13.
Figure 15:
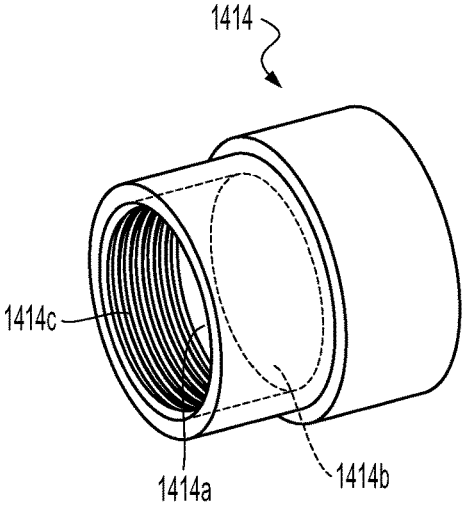
FIG. 15 is a perspective view of an outer closure plug of the fill port of the bladder of FIG. 13.
Figure 16:
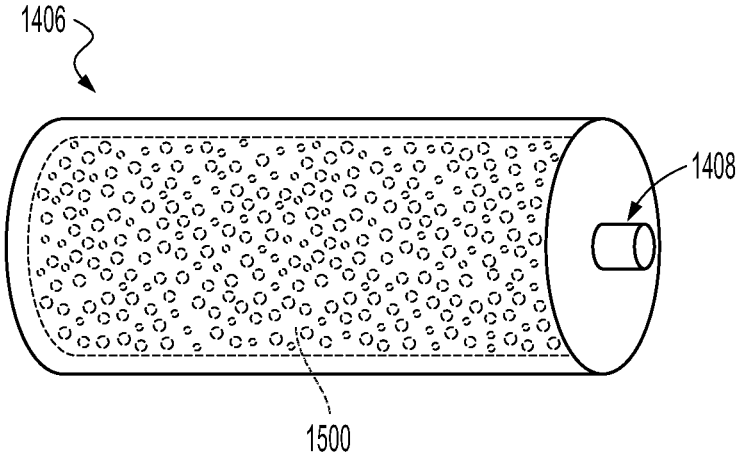
FIG. 16 is a perspective view of the bladder of FIG. 13 shown with dehydrated water beads disposed therein.

Referring now to FIGS. 9 and 10, a rib system 900 may be provided for use with the fitness training bag 10 in accordance with the present disclosure. The rib system 900 includes a plurality of straps and may be secured to the fitness training bag 10 to allow for additional exercises to be performed with the fitness training bag 10 and/or to allow for different grips to be used with the fitness training bag 10.

The rib system 900 includes securement straps 930 and holding straps 940 that form a grid. The securement straps 930 are aligned in a direction substantially perpendicular to each of the holding straps 940. Each of the securement straps 930 includes a retained portion 932, a retention portion 934, and a free portion 936. The retained portion 932 of each of the securement straps 930 is secured to each of the holding straps 940 at attachment sections 942. The securement straps 930 may be secured at each of the attachment sections 942 by stitching the holding straps 940 and the securement straps 930 together. Each of the retention portions 934 has a loop 937 secured to an end 935 thereof. The free portions 936 are configured to pass through a respective loop 937 and to fold back to secure to itself to secure the securement strap 930 over the fitness training bag 10. The free portions 936 may include a fastener system 938 disposed on a surface thereof such that when the free portions 936 are passed through the loop 937 of the fastener system 938 to secure the free portion 936 to itself and the securement strap 930 about the fitness training bag 10. The first and second handles 210, 220 may prevent the rib system 900 from sliding off the end of the fitness training bag 10. The fastener system 938 may be a hook and loop fastener system.

As shown in FIG. 10, with the rib system 900 secured about the fitness training bag 10, each of the holding straps 940 and securement straps 930 may be used to provide additional grips to the fitness training bag 10. In addition, each of the strap securement straps 930 and holding straps 940 may be used in conjunction with the first and second handles 210, 220.

Referring now to FIGS. 11-15, another embodiment of a fitness training bag provided in accordance with the present disclosure is illustrated and generally identified by reference numeral 1400. The fitness training bag 1400 is substantially similar to fitness bag 10, and therefore, only the differences therebetween will be described in detail hereinbelow in the interest of brevity.

As will be described hereinbelow, the fitness training bag 1400 is configured to retain a fluid filler material, such as water, or the like. In this manner, the fitness training bag 1400 includes an outer bag 1402 that is substantially similar to outer bag 702 and may be constructed from the same or similar materials to that of outer bag 702. In embodiments, the outer bag may be constructed from a soft or otherwise pliable material suitable for use indoors, such as neoprene, canvas, nylon, etc.

An end portion 1402*a* of the outer bag 1402 includes a reusable closure mechanism 1426 capable of being selectively opened and closed. In this manner, the closure mechanism 1426 includes a first closure 1426*a* disposed on an inner surface of the outer bag 1402 having a fastening system 1426*b* disposed on a complementary portion on the inside of the outer bag 1402. As can be appreciated, the fastening system 1426*b* may be any suitable fastening system known in the art, and in one non-limiting embodiment, the fastening system 1426*b* is a hook-and-loop fastening system. In embodiments, the closure mechanism may include a first closure 1426*a* and a second closure 1426*c*. The first closure 1426*a* includes an inner closure 1426*b* that is configured to initially close the closure mechanism 1426 from an interior portion of the outer bag 1402 and the second closure 1426*c* is configured to wrap around an outer portion of the outer bag 1402 to cover or otherwise be placed on top of the end portion 1402*a* and is selectively coupled to an outer portion 1426*d* of the outer bag 1402 using any suitable means, such as a hook-and-loop fastener.

The fitness training bag 1400 includes an inner bag 1404 that is configured to be received within an interior portion of the outer bag 1402. The inner bag 1404 is constructed from any suitable material, and in embodiments, is constructed from a non-woven material such as polypropylene or polyethylene and may be constructed in various thicknesses. In one non-limiting embodiment, the inner bag 1404 is constructed using a thick non-woven material. In this manner, the inner bag 1404 provides puncture, tearing, or other protection to a bladder 1406 that is configured to be received within an inner portion of the inner bag 1404, as will be described in further detail hereinbelow.

The bladder 1406 is configured to be received within an inner portion of the inner bag 1404 and is configured to receive a fluid thereon, such as water or the like. In this manner, the bladder 1406 is constructed from a waterproof or otherwise water impermeable material such as vinyl, rubber, etc. The bladder 1406 includes a generally tube shaped configuration having first and second opposing end portions 1406*a*, 1406*b* that are sealed or otherwise closed using any suitable means, such as ultrasonic welding, adhesives, etc. In one non-limiting embodiment, the first and second opposing end portions 1406*a*, 1406*b* are hermetically sealed.

An outer surface of the bladder 1406 includes a filling port 1408 including an inner surface 1408*a* defining a passage 1408*b* therethrough such that the interior and exterior of the bladder 1406 are in fluid communication. The filling port 1408 includes a closure mechanism 1410 having a first plug 1412 and a second plug 1414, although it is contemplated that the closure mechanism 1410 may employ any suitable means for closing or otherwise sealing the filling portion 1408 and in embodiments may only include a single plug. In embodiments, the filling port 1408 is flush with the outer bag 1402.

The first plug 1412 is configured to be received within the passage 1408*b* of the filling port 1408 and is frictionally retained therein by frictionally engaging the inner surface 1408*a* of the passage 1408*a* using any suitable means capable of forming a seal against the passage of fluid therethrough. In embodiments, the first plug 1412 may include a plurality of threads 1412*a* defined on an outer surface thereof that is configured to threadably engage a corresponding plurality of threads 1408*c* defined within the inner surface 1408*a* of the passage 1408*b* of the filling port 1408. In this manner, it is contemplated that the plurality of threads 1412*a*, 1408*c* may be any suitable type of thread, such as UN/UNF, NPT/NPTF, etc.

The second plug 1414 includes an inner surface 1414*a* defining a cavity 1414*b* therein that is configured to receive the filling port 1408 therein. The inner surface 1414*a* of the second plug is configured to frictionally engage an outer surface 1408*d* of the filling port 1408 using any suitable means capable of forming a seal against the passage of fluid therein. In embodiments, the inner surface 1414*a* of the second plug 1414 defines a plurality of threads 1414*c* therein configured to threadably engage a corresponding plurality of threads 1408*e* defined on the outer surface 1408*d* of the filling port 1408. In this manner, it is contemplated that the plurality of threads 1414*c*, 1408*e* may be any suitable type of thread, such as UN/UNF, NPT/NPTF, etc., and may be the same or different that the plurality of threads 1412*a*, 1408*c*.

As can be appreciated, when in a closed position, the first and second plugs 1412, 1414 cooperate to ensure that a water tight seal is formed on the filling port 1408 and inhibit fluid from passing through the passage 1408*b* and exiting the bladder 1406. Alternatively, when in an open position, the first and second plugs 1412, 1414 are moved to a position that is clear from the passage 1408*b* of the filling port 1408 of the bladder 1406 such that a fluid, such as water, may flow therethrough and begin to fill the bladder 1406. It is envisioned that the amount of fluid within the bladder 1406 may be varied depending upon the desired weight of the fitness training bag 1400, as will be described in further detail hereinbelow.

With reference to FIGS. 11-15, in use, if initially in the closed position, the reusable closure mechanism 1426 is opened by first de-coupling the second closure 1426*c* from the outer bag 1402, and thereafter, de-coupling the first closure 1426*a* from the outer bag 1402 to expose the inner bag 1404. At this point, the inner bag 1404 is opened to access the filling port 1408 of the bladder 1406. The second plug 1414 is removed from the filling port 1408, and thereafter, the first plug 1412 is removed from the filling port 1408 such that the passage 1408*b* is free from obstruction. Water or another suitable fluid is poured or otherwise injected into the passage 1408*b* of the filling port 1408 until the desired amount of fluid is contained within the bladder 1406.

As can be appreciated, the weight of the fitness training bag 1400 can be varied depending upon the volume of fluid contained within the bladder 1406. Additionally, the volume of fluid contained within the bladder 1406 effects the stability of the fitness training bag 1400, such that as a user handles or otherwise grasps the fitness training bag 1400, the fitness training bag 1400 deforms the fluid within the bladder 1406 shifts such that the center of gravity of the fitness training bag 1400 shifts with use, thereby providing a more rigorous fitness challenge to the user. As can be appreciated, the more the bladder 1406 is filled with fluid, the more the fitness training bag 1400 weighs and the more stable the fitness training bag 1400 becomes. Conversely, the less the bladder 1406 is filled with fluid, the less the fitness training bag 1400 weighs and the less stable the fitness training bag 1400 becomes. Additionally, the use of fluid within the fitness training bag 1400 provides a more pliable bag that provides for softer impacts when used as a lifting weight or as an added weight when placed on a user's shoulders.

Once the bladder 1406 has been filled with the desired volume of fluid, the first plug 1412 of the filling port 1408 is secured to the filling port 1408, and thereafter, the second plug 1414 is secured to the filling port 1408 to ensure that fluid is inhibited from passing through the passage 1408*b*. At this point, the inner bag 1404 is closed, and thereafter, the first closure 1426*a* is coupled to the outer bag 1402. To fully close the fitness training bag 1400, the second closure 1426*c* is coupled to the outer bag 1402 to ensure that the inner bag 1404 and the bladder 1406 are securely retained within the outer bag.

As can be appreciated, the above method may be repeated as many times as necessary and may be repeated to adjust the amount of fluid contained within the bladder 1406 to vary the overall weight of the fitness training bag 1400.

Turning to FIGS. 11-16, it is contemplated that the fitness training bag 1400 may include dehydrated water beads 1500 that may be added to the fluid contained within the bladder 1406. The dehydrated water beads 1500 may be any suitable type of absorbent, such as a superabsorbent polymer (SAP), etc. As can be appreciated, SAP's include a polyacrylamide (Poly(methyl acrylate) or Sodium polyacrylate) having an ability to absorb and retain large amounts of fluid relative to their own mass, and in instances may absorb up to 300 times its weight when placed in a solution of deionized and distilled water and up to 50 times its weight when placed in a solution containing up to 0.9% saline, thereby affecting the amount the dehydrated water beads 1500 swell and the overall consistency of the swollen dehydrated water beads 1500.

In this manner, the type and degree of cross-linker used to make the SAP impacts the SAP's ability to absorb fluid and impacts the consistency of the swollen dehydrated water beads 1500. Specifically, low-density cross-linked SAP's generally include a higher absorbent capacity and swell to a larger degree, thereby having a softer and "stickier" gel formation. In contrast, high-density cross-linked SAP's generally include a lower absorbent capacity and swell to a lesser degree, thereby having a firmer gel formation capable of maintaining its overall shape under pressure. In embodiments, the swollen dehydrated water beads 1500 may include a size variation between 6 mm and 30 mm.

The dehydrated water beads 1500 placed within the bladder 1406 of the fitness training bag absorb a portion of the fluid or water contained within the bladder 1406, increasing the overall stiffness of the fitness training bag 1400 compared to the fitness training bag 1400 having only fluid contained within the bladder 1406. As can be appreciated, the amount of fluid or water within the bladder 1406 that is absorbed within the bladder 1406, and therefore the overall stiffness of the fitness training bag 1400, can be varied by the amount of dehydrated water beads 1500 placed within the bladder 1406.

In use, the stiffness of the fitness training bag 1400 affects the overall stability of the fitness training bag 1400. As can be appreciated, the dehydrated water beads enable a user to vary the stability of the fitness training bag 1400 between that of a fitness training bag containing a filler 150 composed of rubber or other similar material, and that of a fitness training bag containing only fluid, thereby varying the effort required to utilize the fitness training bag.

In use, after filling the bladder 1406 of the fitness training bag 1400 with the desired amount of fluid or water, a desired amount of dehydrated water beads 1500 are added to the bladder 1406 depending upon the desired level of stiffness of the fitness training bag 1400. As can be appreciated, the water is absorbed by the dehydrated water beads 1500 over the course of several hours, depending upon the type and amount of dehydrated water beads 1500 added to the bladder 1406. After adding the desired amount of dehydrated water beads 1500, the fitness training bag 1400 is closed using a similar procedure to that described hereinabove regarding the bladder 1406 being filled with fluid or water.

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise.

For example, it is contemplated that the bag may be utilized without handles for a particular purpose and to perform a particular exercise. In one instance the handles 500 are removed (e.g., removable handles) and a particular type of exercise is performed. In one embodiment, the bag may be constructed without handles 500 and simply used in this fashion. In another contemplated embodiment, the inner bag 104, outer bag 106 or intermediate bag 106 may be filled with only one material (e.g., one type of filler) or one or more materials with the same density depending upon a particular purpose.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed is:

1. A fitness training bag, comprising:

a body defining a first interior volume therein;

a bladder disposed within the first interior volume, the bladder defining a second interior volume therein;

a fluid disposed within the second interior volume;

dehydrated water beads disposed within the second interior volume; and a handle coupled to the body and configured to facilitate manipulation of the body to perform an exercise.

2. The fitness training bag according to claim 1, wherein the body includes:

an outer bag enclosing a first interior area therein, the bladder disposed within the first interior area.

3. The fitness training bag according to claim 2, wherein the body further includes an inner bag disposed within the first interior area of the outer bag, the inner bag defining a second interior area therein.

4. The fitness training bag according to claim 3, wherein the bladder is disposed within the second interior area.

5. The fitness training bag according to claim 4, wherein a first end of the outer bag defines an opening therein in operable communication with the first interior area, the outer bag including a first closure disposed on an inner surface thereof that is configured to selectively cover the opening on an exterior portion thereof.

6. The fitness training bag according to claim 5, wherein the outer bag includes a second closure disposed on an outer surface thereof that is configured to selectively cover the opening on an interior portion thereof.

7. The fitness training bag according to claim 1, wherein the dehydrated water beads are superabsorbent polymers.

8. The fitness training bag according to claim 7, wherein the dehydrated water beads are high density cross-linking superabsorbent polymers.

9. The fitness training bag according to claim 7, wherein the dehydrated water beads are low density cross-linking superabsorbent polymers.

* * * * *